US012055332B2

(12) United States Patent
Notaney et al.

(10) Patent No.: US 12,055,332 B2
(45) Date of Patent: Aug. 6, 2024

(54) DEVICES FOR SHAPING CLEAR ICE PRODUCTS AND RELATED METHODS

(71) Applicant: Abstract Ice, Inc., Petaluma, CA (US)

(72) Inventors: Ashok Kumar Notaney, San Francisco, CA (US); Todd Stevenson, Novato, CA (US); Andrew James Whalen, Windsor, CA (US); Bryce Edmund Peterson, Hayward, CA (US); Luke W. Clauson, Reno, NV (US); Matthew Byrnes Newell, Reno, NV (US); Thomas Michael Rector, Gardnerville, NV (US)

(73) Assignee: ABSTRACT ICE, INC., Petaluma, CA (US)

( * ) Notice: Subject to any disclaimer, the term of this patent is extended or adjusted under 35 U.S.C. 154(b) by 0 days.

(21) Appl. No.: 18/253,711

(22) PCT Filed: Nov. 19, 2021

(86) PCT No.: PCT/US2021/060039

§ 371 (c)(1),
(2) Date: May 19, 2023

(87) PCT Pub. No.: WO2022/109237

PCT Pub. Date: May 27, 2022

(65) Prior Publication Data

US 2023/0392849 A1 Dec. 7, 2023

Related U.S. Application Data

(60) Provisional application No. 63/276,509, filed on Nov. 5, 2021, provisional application No. 63/116,453, filed on Nov. 20, 2020.

(51) Int. Cl.
*F25C 5/14* (2006.01)

(52) U.S. Cl.
CPC ..... *F25C 5/14* (2013.01)

(58) Field of Classification Search
CPC ..... F25C 5/14; F25C 1/04
(Continued)

(56) References Cited

U.S. PATENT DOCUMENTS 3,098,361 A * 7/1963 Haase ..... C01B 32/55 62/341
3,721,103 A * 3/1973 Brandt ..... F25C 1/04 62/73

(Continued)

FOREIGN PATENT DOCUMENTS

CN 1132344 A * 10/1996 ..... B30B 11/14
CN 114234508 A 3/2022

OTHER PUBLICATIONS

CN-1132344-A, machine translation (Year: 2023).*
International Search Report and Written Opinion for PCT/US2021/060039 dated Mar. 22, 2022, 8 pages.

*Primary Examiner* — Eric S Ruppert
*Assistant Examiner* — Kirstin U Oswald
(74) *Attorney, Agent, or Firm* — Aurora Consulting LLC; Kristen J. Hansen; Ashley Sloat

(57) ABSTRACT

Methods and devices are described for shaping ingots of ice. Devices may include a support structure, a mold for shaping ice ingots, the mold being mounted to the support structure. The devices may also include a first upper platen assembly disposed above a first lower platen assembly, a first positioning means, and at least one liquid inlet valve for each of the first upper platen assembly and the first lower platen assembly.

22 Claims, 24 Drawing Sheets

(58) Field of Classification Search
USPC ..... 62/75, 347, 356; 299/24
See application file for complete search history.

(56) References Cited

U.S. PATENT DOCUMENTS

| | | | | |
|---|---|---|---|---|
| 4,910,974 | A * | 3/1990 | Hara | F25C 1/045 62/352 |
| 5,090,210 | A * | 2/1992 | Katayanagi | F25C 1/04 62/135 |
| 5,187,948 | A | 2/1993 | Frohbieter | |
| 8,882,489 | B1 * | 11/2014 | Coomer | F25C 5/14 425/408 |
| 9,074,802 | B2 * | 7/2015 | Culley | F25C 1/25 |
| 9,200,823 | B2 * | 12/2015 | Boarman | F25C 1/18 |
| 9,234,689 | B2 * | 1/2016 | Son | F25C 1/10 |
| 9,459,034 | B2 * | 10/2016 | Boarman | F25C 1/04 |
| 9,476,629 | B2 | 10/2016 | Boarman | |
| 9,651,290 | B2 * | 5/2017 | Boarman | F25B 21/02 |
| 9,784,492 | B2 | 10/2017 | Little et al. | |
| 10,697,684 | B2 * | 6/2020 | Bertolini | F25C 1/25 |
| 11,408,661 | B2 * | 8/2022 | Junge | F25C 5/08 |
| 2004/0206250 | A1 * | 10/2004 | Kondou | F25C 5/14 99/426 |
| 2005/0160741 | A1 * | 7/2005 | Park | F25C 1/22 62/340 |
| 2012/0318003 | A1 * | 12/2012 | Kim | F25C 5/08 62/340 |
| 2014/0047859 | A1 * | 2/2014 | Schwulst | F25C 5/08 62/340 |
| 2014/0165598 | A1 | 6/2014 | Boarman et al. | |
| 2014/0165619 | A1 * | 6/2014 | Culley | F25C 5/08 62/344 |
| 2017/0082338 | A1 * | 3/2017 | Wobrock | F25C 1/22 |
| 2020/0158402 | A1 | 5/2020 | Kim et al. | |

* cited by examiner

DEVICES FOR SHAPING CLEAR ICE PRODUCTS AND RELATED METHODS

CROSS-REFERENCE TO RELATED APPLICATIONS

This application is a 35 U.S.C. 371 National Stage Application of PCT/US2021/60039, filed Nov. 19, 2021, which claims the priority benefit of U.S. Provisional Application No. 63/276,509, filed on Nov. 5, 2021, and the priority benefit of U.S. Provisional Application No. 63/116,453, filed on Nov. 20, 2020, the disclosures of which are herein incorporated by reference in their entireties.

INCORPORATION BY REFERENCE

All publications and patent applications mentioned in this specification are herein incorporated by reference in their entirety, as if each individual publication or patent application was specifically and individually indicated to be incorporated by reference in its entirety.

TECHNICAL FIELD

This disclosure relates generally to the field of ice manufacturing, and more specifically to the field of clear ice manufacturing. Described herein are devices and methods for producing clear ice.

BACKGROUND

From the end of the prohibition era to modern day, craft cocktails are a mainstay in most restaurants and bars. To enhance the overall experience, many restaurants and bars add garnishes and/or specialty ice to the cocktails. Currently, these restaurants and bars buy large blocks of ice that are then cut down in-house to the appropriate size for each drink. Some companies in the space claim to produce clear ice using directional freezing, but the clarity of the ice and scalability of the technology are questionable. Further, issues with standard ice machines include cracking, trapped air bubbles, and water impurities resulting in ice that lacks the desired appeal and appearance. There is a need for new and useful device and method for shaping ice.

SUMMARY

In a first general aspect, an apparatus is described for shaping ice. The apparatus may comprise a support structure and a mold for shaping ice ingots. The mold may be mounted to the support structure and may include a first mold housing having one or more surfaces and a second mold housing having one or more surfaces. The apparatus may further include a first upper platen assembly disposed above a first lower platen assembly, where each of the first upper platen assembly and the first lower platen assembly include at least one channel for receiving liquid therethrough. The apparatus may further include a first positioning means for disposing at least one of the one or more surfaces of the first mold housing adjacent to the first upper platen assembly and disposing at least one of the one or more surfaces of the second mold housing to the first lower platen assembly, the first positioning means including a linear actuator. The apparatus may further include at least one liquid inlet valve for each of the first upper platen assembly and the first lower platen assembly, each liquid inlet valve configured to control a flow of liquid through the at least one channel of the first upper platen assembly and the at least one channel of the first lower platen assembly.

Particular implementations of the apparatus may include any or all of the following features. In some embodiments, at least one of the one or more surfaces of the first mold housing and at least one of the one or more surfaces of the second mold housing define a plurality of mold cavities when placed in an adjacent position. In some embodiments, the first mold housing and the second mold housing are suspended between the first lower platen assembly and the first upper platen assembly. In some embodiments, the positioning means is configured to enable a vertical upward movement of the first lower platen assembly until the first lower platen assembly contacts the at least one of the one or more surfaces of the second mold housing. In some embodiments, the first mold housing and the second mold housing are suspended between the first lower platen assembly and the first upper platen assembly by at least two vertical reciprocating shafts.

In some embodiments, the positioning means is configured to enable a vertical upward movement of the first mold housing until the at least one of the one or more surfaces of the first mold housing contacts the first upper platen assembly. In some embodiments, the positioning means is configured to cause a vertical upward movement of the first lower platen assembly until the first lower platen assembly is in contact with the at least one of the one or more surfaces of the second mold housing. In some embodiments, the positioning means is configured to cause a vertical upward movement of the first mold housing until the at least one of the one or more surfaces of the first mold housing contacts the first upper platen assembly. In some embodiments, the liquid comprises water heated to cause the first upper platen assembly and the first lower platen assembly to be heated to a surface temperature of at least a temperature of about 40 degrees Celsius. In some embodiments, the first mold housing and the second mold housing are thermally heated based on the contact with the at least one of the one or more surfaces of the first mold housing and the first upper platen assembly and the contact with the at least one of the one or more surfaces of the second mold housing and the first lower platen assembly.

In some embodiments, the apparatus further includes a transfer table to receive the mold and a second upper platen assembly disposed above a second lower platen assembly, wherein the second upper platen assembly comprises a housing mechanically connected to the support structure, the second upper platen assembly and the second lower platen assembly being adjacent to the first upper platen assembly and controlled by a second positioning means.

In some embodiments, the second upper platen assembly and the second lower platen assembly are configured to cool the mold based on a trigger event received by the positioning means, where the trigger event causes a vertical upward movement of the first mold housing until at least one of the one or more surfaces of the first mold housing physically contacts the second upper platen assembly and at least one of the one or more surfaces of the second mold housing physically contacts the second lower platen assembly.

In some embodiments, the first mold housing and the second mold housing are configured to maintain tension against an ice ingot placed between the first mold housing and the second mold housing where the tension is maintained during heating of the ice ingot and removed upon detecting that the first mold housing and the second mold housing are located a predefined distance apart. In some embodiments, removing the tension causes the first positioning means to trigger a downward movement of both the first lower platen assembly and the first mold housing to remove physical contact between the first mold housing and the first upper platen assembly and to remove the physical contact between the second mold housing and the first lower platen assembly.

In some embodiments, the first upper platen assembly is fixed. In some embodiments, the first lower platen assembly is configured to move according to the positioning means. In some embodiments the first mold housing the second mold housing are configured to move according to the positioning means. In some embodiments, in response to detecting that the first mold housing and the second mold housing are located a predefined distance apart, the positioning means is configured to cause a downward movement of the first lower platen assembly, the first mold housing, and the second mold housing to remove physical contact between the first mold housing and the first upper platen assembly and to remove physical contact between the second mold housing and the first lower platen assembly. In some embodiments, the mold is semi-flexible and comprises a plurality of pockets, where each pair of the plurality of pockets is disposed between an articulating joint to allow movement during heating or cooling of the ice ingot held by the mold.

In some embodiments, the first mold housing further includes at least two side surfaces in contact with the at least one top surface, the at least two side surfaces of the first mold housing including a plurality of structures that extend into the plurality of mold cavities to hold the ice ingot. In some embodiments, the second mold housing further includes at least two side surfaces attached to the at least one bottom surface, where the at least two side surfaces of the second mold housing include a plurality of additional structures that extend into the plurality of mold cavities to hold the ingot. In some embodiments, the mold is interchangeable with molds of a plurality of shapes and sizes. In some embodiments, the mold further comprises a plurality of outlets configured to drain liquid water from a plurality of cavities associated with the mold.

In some embodiments, the apparatus further includes a computing device, wherein the computing device includes at least one processor and memory storing instructions that when executed cause the at least one processor device to generate and trigger display of at least one user interface configured to receive user input corresponding to a platen clamping metric, a recipe for shaping the ice ingot, a mold size, and a mold shape.

In a second general aspect, a method is described for shaping ice. The method may include providing a mold with a plurality of mold cavities, the mold including at least a first mold housing and a second mold housing, providing a first upper platen assembly disposed above a first lower platen assembly, each of the first upper platen assembly and the first lower platen assembly including at least one heating mechanism, receiving an ice ingot in the mold, causing the mold to at least partially encapsulate the ice ingot, causing thermal heating of the first lower platen assembly and the first upper platen assembly to a predefined temperature, and causing the first upper platen assembly to physically contact at least a first mold surface of the mold while causing the first lower platen assembly to physically contact at least a second mold surface of the mold, where each physical contact triggers selective heating of the ice ingot, for a predefined time period, such that the ice ingot selectively melts to form a plurality of sufficiently distinct ice shapes as defined by the plurality of mold cavities. The method may further include in response to detecting that the first mold housing and the second mold housing are located a predefined distance apart, causing a downward movement of both the first lower platen assembly and the mold to remove the physical contact between the first mold surface and the first upper platen assembly and to remove the physical contact between the second mold surface and the first lower platen assembly.

Particular implementations of the method may include any or all of the following features. In some embodiments, the method may further include performing at least one post processing step on the plurality of sufficiently distinct ice shapes. In some embodiments, the at least one post processing step comprises selectively cooling the ice ingot to refreeze surface water associated with the ice ingot. In some embodiments, the at least one post processing step comprises causing horizontal movement of the mold housing the heated ice ingot therein via a transfer table, so that the mold is suspended between a second upper platen assembly disposed above a second lower platen assembly.

In some embodiments, the method further includes causing the second upper platen assembly to physically contact at least one mold surface of the first mold housing while causing the second lower platen assembly to physically contact at least one mold surface of the second mold housing, each physical contact triggering cooling of the mold, and in response to detecting that the mold meets a predefined temperature threshold, the method may include removing the plurality of sufficiently distinct ice shapes from the mold.

In some embodiments, the method further includes causing the second upper platen assembly to physically contact at least one mold surface of the first mold housing while causing the second lower platen assembly to physically contact at least one mold surface of the second mold housing, each physical contact triggering cooling of the mold, and in response to cooling for a predefined period of time, causing the second upper platen assembly and the second lower platen assembly to move to remove the respective physical contact, and removing the plurality of sufficiently distinct ice shapes from the mold.

In some embodiments, the first upper platen assembly and the first lower platen assembly each include a channel to receive a flow of liquid, and causing the thermal heating of the first lower platen assembly and the first upper platen assembly to a predefined temperature comprises causing a flow of water through the channel defined for each of the first lower platen assembly and the first upper platen assembly, where the water is preheated by at least one heating mechanism associated with the first upper platen assembly or the first lower platen assembly.

In some embodiments, the first upper platen assembly and the first lower platen assembly each include a channel to receive a flow of liquid and the method further includes causing the thermal heating of the first lower platen assembly and the first upper platen assembly to a predefined temperature comprises causing a flow of liquid through the channel defined for each of the first lower platen assembly and the first upper platen assembly, where the liquid is configured to heat the mold. In some embodiments, causing the thermal heating of the first lower platen assembly and the first upper platen assembly to a predefined temperature comprises electronically heating the first lower platen assembly and the first upper platen assembly.

In some embodiments, the mold is a multipocketed mold configured to hold the ice ingot. In some embodiments, each of the plurality of sufficiently distinct ice shapes are separate, individual volumes of ice and each of the plurality of sufficiently distinct ice shapes are tethered together by an ice bridge to form a sprue of ice shapes. In some embodiments, the mold further comprises a drain system that drains liquid water from the plurality of mold cavities. In some embodiments, the plurality of mold cavities are a shape selected from the group consisting of: a cuboid shape, a polyhedron shape, a sphere shape, a heart shape, a diamond shape, a clover shape, a polygon shape, and a hemispherical shape. In some embodiments, the mold is suspended between the first lower platen assembly and the first upper platen assembly by at least two vertical reciprocating shafts and configured to be moved by a positioning means that includes at least one linear actuator. In some embodiments, the mold is interchangeable with molds of a plurality of shapes and sizes.

In a third general aspect, an apparatus is described for shaping ice. The apparatus may include a support structure, a mold for shaping ice ingots, the mold being mounted to the support structure and including a plurality of mold cavities configured with a drain system for draining water, a first upper platen assembly disposed above a first lower platen assembly, each of the first upper platen assembly and the first lower platen assembly including at least one heating mechanism, and a first positioning means for disposing at least one surface of the mold adjacent to the first upper platen assembly and disposing at least one additional surface of the mold to the first lower platen assembly.

Particular implementations of the apparatus may include any or all of the following features. In some embodiments, the mold is thermally heated via the heating mechanism to selectively melt the ice ingot to form a plurality of sufficiently distinct ice shapes as defined by the plurality of mold cavities.

In a fourth general aspect, a method is described for shaping ice. The method may include providing a multipocketed mold including a first mold housing and a second mold housing, each including a plurality of mold surfaces and wherein each mold surface of the first mold housing corresponds to a mold surface of the second mold housing such that corresponding mold surfaces define a plurality of mold cavities when the first mold housing and the second mold housing are placed in an adjacent position, where the first and second mold housings each further include at least one heating element. The method may further include receiving an elongate ingot of clear ice in a position between the first mold housing and the second mold housing, selectively heating the elongate ingot of clear ice with the respective at least one heating elements such that the elongate ingot of clear ice selective melts to form a plurality of sufficiently distinct ice shapes as defined by the plurality of cavities, wherein the first mold housing and the second mold housings enter an adjacent position during the selective heating, and removing the plurality of sufficiently distinct ice shapes from the multipocketed heated mold.

Particular implementations of the method may include any or all of the following features. In some embodiments, the plurality of sufficiently distinct ice shapes are separate, individual volumes of ice and the plurality of sufficiently distinct ice shapes are tethered together by an ice bridge to form a sprue of ice shapes. In some embodiments, the multipocketed mold further comprises a drain system that drains liquid water from the plurality of mold cavities. In some embodiments, the plurality of mold cavities have a shape selected from the group consisting of a cube shape, a polyhedron shape, a sphere shape, a heart shape, a diamond shape, and a clover shape.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

Figure 1:
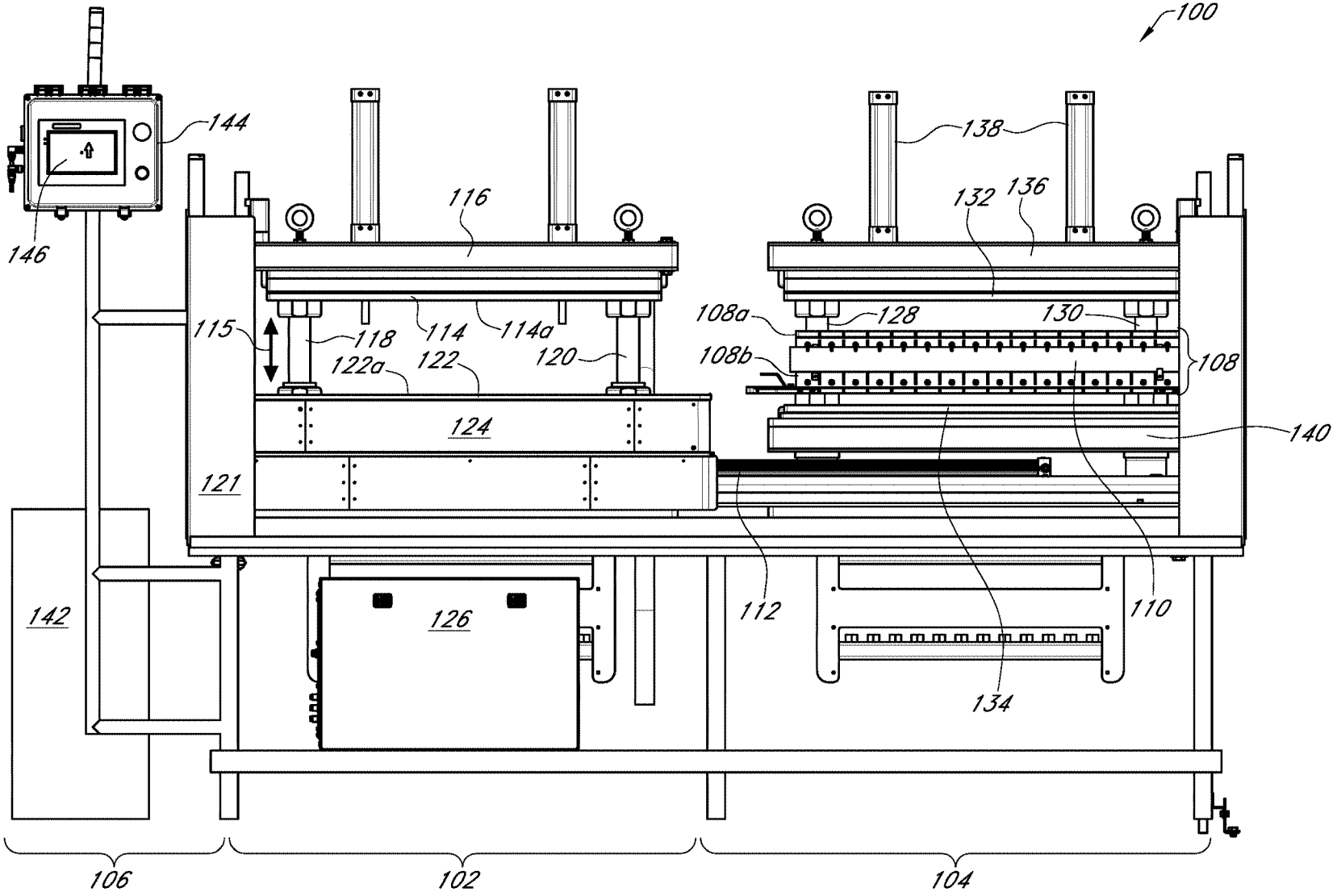
FIG. 1 illustrates an example device for shaping an elongate ingot of ice.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

This disclosure relates generally to devices, systems, and methods for shaping and harvesting ice ingots. For example, the devices, systems, and methods described herein may be configured to shape and harvest ice in a variety of shapes that are ready for use in beverages. In general, the ice shaped by the devices, systems, and methods described herein are generated from elongate ingots of ice generated by an ice making machine. The ice ingots may be obtained or otherwise received by the devices described herein in a clear, crystalline form. However, the devices, systems, and methods described herein may be configured to function with ice of any clarity, shape, and/or size.

In some embodiments, the ice ingots have a bottom surface, a first side surface, a second side surface, and a top surface. In some embodiments, the ice ingots shaped by the devices and methods described herein may measure about one meter to about four meters in length. In some embodiments, the ice ingots shaped by the devices and methods described herein may measure about 30 centimeters to about 80 centimeters in length. In some embodiments, the ingots are cylindrical or semi-cylindrical or non-symmetrical and may have a radius of about 1.25 centimeters to about 2 centimeters. In some embodiments, the ingots are cylindrical or semi-cylindrical and may have a radius of about 2 centimeters to about 5 centimeters. In some embodiments, the ingots are cylindrical or semi-cylindrical and may have a radius of about 5 centimeters to about 8 centimeters.

In some embodiments, the molds described herein may be configured to process (e.g., shape) ingots of the same length to produce multiple pieces of shaped ice per cycle. In some embodiments, the molds may be a single cavity mold arranged on a rotary table. The single cavity mold may be shaped and arranged for cutting by a blade or spike. The single cavity mold may allow for a single part flow without the complexity of a multicavity mold. In some embodiments, the mold may be a multi-plate mold with a number of separate portions (e.g., plates) that may be heated and/or cooled.

As used herein, the term "shaping" may include forming, cutting, melting, embossing, etching, planing, or any other methods of producing ice having a desired shape, form, or appearance. As used herein, the term "shape" may include any three-dimensional forms including, but not limited to a cuboid shape, a polyhedron shape, a sphere shape, a heart shape, a diamond shape, a clover shape, a polygon shape, a hemispherical shape, and the like.

In some embodiments, a shape may represent a portion and/or an entirety of a mold cavity. In some embodiments, a mold may include a plurality of mold cavities where each mold cavity is configured in a shape selected from the group consisting of: a cuboid shape, a polyhedron shape, a sphere shape, a heart shape, a diamond shape, a clover shape, a polygon shape, and a hemispherical shape. Although one of skill in the art will appreciate that any of the molds or devices or systems described herein may be adapted for processing a singular ice structure, such as a cube or sphere, resulting from, for example, an about eight cubic inch mold or an about 2.75 cubic inch mold. Any mold size may be configured to create any sized ice form therein for processing by any of the devices, systems, and methods described herein.

Systems and Devices

The devices (e.g., systems, apparatuses) described herein may function to produce shaped ice. For example, such devices may be used for shaping ice in any situation where transparent (e.g., unclouded) or non-transparent ice is desired, such as for consumption in cocktails and other beverages, but can additionally or alternatively be used for any suitable applications where a liquid material is frozen. As used herein, shaping ice may refer to heating and cooling molds to respectively melt liquid and/or refreeze liquid to form several shaped structures according to one or more cavity shapes defined by a particular mold.

In some embodiments, the devices described herein function to shape ice ingots into a number of different shapes and sizes by strategically melting portions of the ice ingots that are seated partially or wholly within one or more molds. The molds described herein may include mold cavities of particular sizes and/or shapes. The molds described herein may be interchangeably installed into an ice shaping apparatus. For example, the molds may be single part or multipart and may be interchangeable with other molds for purposes of shaping ice with a plurality of different shapes and sizes. For example, a first mold (or mold assembly) may be configured to generate 1 to 10; 10 to 50; or 1 to 50 shaped ice structures from an elongate, ice ingot. The received ice ingot may be substantially rectangular, asymmetric (e.g., one side that is substantially semi-circular opposite a second side that us substantially rectangular), symmetric, cylindrical, etc. Further, the molds may be adapted to receive other sizes and shapes of ice ingots and may be configured to generate ice structures with any other moldable shape or size associated with a particular installed mold (or mold assembly).

For example, a distance between a first mold housing and a second mold housing may be adjusted to accommodate larger or smaller ice ingots or input ice structures. Alternatively, or additionally, a curvature of a surface of the first mold housing that is complementary to a surface of the second mold housing may be adapted or altered to accommodate ice ingots or input ice structures of varying shapes and/or sizes. Alternatively, or additionally, an offset between the first mold housing and the second mold housing may be adjusted to accommodate ice ingots or input ice structures of varying shapes and/or sizes.

In some embodiments, the molds described herein are multipart molds. For example, a mold may include an upper portion and a lower portion that, when brought together within the ice shaping apparatus, form one, one or more, or a plurality of shaped mold cavities. In some embodiments, more than two mold portions may be used for purposes of generating additional three-dimensional ice shapes.

In operation, the ice shaping devices (e.g., apparatuses, systems) described herein may function to shape ice ingots using heating and/or cooling steps. Such steps may be carried out using a combination of materials configured to heat and/or cool molds or containers that may encapsulate and/or partially encapsulate ice ingots. The ice shaping devices described herein may employ electrical heating or cooling techniques, plumbed heating or cooling techniques via thermal transfer (e.g., using a heated or cooled fluid), induction heating or cooling techniques, or a combination thereof. In some embodiments, the ice shaping devices described herein may be configured to heat and/or cool ice ingots by heating or cooling a mold configured to generate, hold, or encase an ice ingot. The heating and cooling may function to generate a specific shape of ice from a larger block of ice. The input ice may be from a singular mold or from an elongate ice ingot generating device.

FIG. 1 illustrates an example device 100 for shaping an ingot of ice. The device 100 represents an ice shaping apparatus that may receive an ice ingot and perform heating and cooling to shape the received ice ingot into many distinct and separate ice shapes (e.g., structures). The shape may be dependent on a selected and installable mold that is configured with one or more or a number of cavities, each of a particular shape. In general, the device 100 may employ a mold housing to generate one or more or multiple ice shapes at a time by heating an ice ingot and subsequently cooling the shaped and molded ice structures.

At a high level, the device 100 includes a heating station 102, a cooling station 104, and a computing station 106 configured to receive commands to operate the device 100. The device 100 may be adapted to receive a mold 108. The mold 108 may be interchangeable with other molds (not shown) to enable a user to use device 100 to generate a number of different shapes and sizes of ice from an ice ingot 110, for example. The mold 108 housing an ice ingot (e.g., ingot 110) may be transferred between the heating station 102 and the cooling station 104 via a transfer table 112 that is configured to receive and transfer the mold 108 and/or any ice ingot or finished ice structures being processed by device 100. The transfer table 112 may be moved using pneumatic actuators and bearings on rails that may function to shuttle the table left to right as well as to lift molds upward and downward.

As shown, the mold 108 includes a first mold housing 108*a* and a second mold housing 108*b*. The first mold housing 108*a* may be placed adjacent to the second mold housing 108*b* (e.g., vertically joined until reaching physical contact between the two mold housings) in order to mold (e.g., shape) ice ingot 110 into a plurality of ice structures in the shape of the mold cavities (not shown) defined by mold 108. While two mold housings are shown for mold 108, any number of mold housings may be fitted for use with device 100. Although the mold 108 is shown associated with the cooling station 104 in this example, the mold 108 may instead be positioned within the heating station 102 and may be moved between both the heating station 102 and the cooling station 104 via transfer table 112, for example. The following example describes the mold 108 being placed within the heating station 102. Additionally, although all components are shown in a horizontal orientation (using vertical movement between them), one of skill in the art will appreciate that the devices and systems described herein may be configured vertically, for example such that the mold portions move horizontally towards one another to process the input ice structure.

The heating station 102 includes a first upper platen assembly 114 movably mounted to a top support structure 116 by means of a positioning mechanism that includes at least a linear actuator. The linear actuator may trigger movement, sequentially or simultaneously, for any or all of the first upper platen assembly 114, the mold 108 (e.g., mold housing 108*a* and mold housing 108*b*), and/or other corresponding components associated with or connected to assembly 114 and/or mold 108. The movement may be upward or downward along vertical motion (e.g., shown by arrow 115). For example, the mold 108 may be suspended between the upper platen assembly 114 and a lower platen assembly 122. The mold 108 and the upper platen assembly 114 may be configured to move via linear actuator along a first reciprocating shaft 118 and a second reciprocating shaft 120. For example, the upper platen assembly 114 may be moved in a vertical motion (shown by arrow 115) by the linear actuator.

The heating station 102 also includes the lower platen assembly 122 movably mounted to a bottom support structure 124 by means of the positioning mechanism that includes the linear actuator. The linear actuator may trigger movement, sequentially or simultaneously, for any or all of the upper platen assembly 114, the mold 108 (e.g., mold housing 108*a* and mold housing 108*b*), the lower platen assembly 122, and/or other corresponding components associated with or connected to assemblies 114, 122 and/or mold 108. The movement may be upward or downward along vertical motion (e.g., shown by arrow 115). For example, the mold 108 may be suspended between the upper platen assembly 114 and a lower platen assembly 122. The mold 108 and the lower platen assembly 122 may be configured to move via linear actuator along a first reciprocating shaft 118 and the second reciprocating shaft 120. For example, the lower platen assembly 122 may be moved in a vertical motion (shown by arrow 115) by the linear actuator.

The linear actuator (e.g., the first positioning means) may be configured to dispose at least one surface of the mold 108 to be adjacent to the upper platen assembly 114 and to dispose at least one additional surface of the mold to the lower platen assembly 122. Such movement may be sequential or simultaneous. For example, the positioning means is configured to enable a vertical upward movement of the lower platen assembly 122 until the lower platen assembly 122 contacts at least one of the one or more surfaces of the second mold housing 108*b*. Similarly, the positioning means is configured to enable a vertical downward movement of the first mold housing 108*a* until at least one of the one or more surfaces of the first mold housing 108*a* contacts the upper platen assembly 114. The movement of the platen assemblies 114, 122 functions to create physical contact with at least one surface of the mold to heat the mold via the platen assemblies 114, 122.

Alternatively, one or both of the upper mold portion and the lower mold portion may be coupled to the upper platen assembly and the lower platen assembly, respectively, before cycle initiation. In such embodiments, heating or cooling may occur immediately or upon a trigger event (e.g., user input, detection of movement of the upper or lower platen assembly, etc.).

As shown, the upper platen assembly 114 is disposed above the lower platen assembly 122. The upper platen assembly 114 includes a plurality of surfaces. For example, a bottom surface 114*a* faces toward the lower platen assembly 122. In particular, the bottom surface 114*a* faces toward a top surface 122*a* of the lower platen assembly 122.

In some embodiments, the upper platen assembly 114 is seated in a fixed position. In such examples, the mold 108 and lower platen assembly 114 may be configured to move upward toward the upper platen assembly 114 when a trigger event is detected (e.g., heating and/or cooling is requested by computing station 106), which may trigger the positioning means to move such components. For example, if the upper platen assembly 114 is fixed, the lower platen assembly 122 may be configured to move according to the positioning means and the first mold housing 108*a* and the second mold housing 108*b* may also be configured to move according to the positioning means. The movement may be upward toward the assembly 114 or downward away from the assembly 114.

The mold housing 108*a* and the mold housing 108*b* may be suspended between the lower platen assembly 122 and the upper platen assembly 114 by at least two vertical reciprocating shafts 118 and 120. In some embodiments, during operation of device 100, a user or device may attempt to reach into device 100. To avoid malfunctions of device 100 or accidents involving device 100, a front portion 121 of device 100 may include an electronic light curtain that functions to disable operation of device 100 if a user or object is detected to move within a proximity or barrier of the device. The proximity or barrier may be defined, maintained, and operated by the light curtain. Additionally, or alternatively, one or more sensor technologies may be employed to ensure safety about device 100. For example, an image sensor may be used to detect movement around device 100; a proximity sensor may be used to detect objects approaching device 100; a motion sensor may be used to detect motion around device 100; etc.

If the housing 108*a* and the housing 108*b* are in the process of heating an ingot 110, for example, the housing 108*a* may be moved into contact with surface 114*a* of platen assembly 114 while platen 122 may be moved upward to be in physical contact with surface 122*a* such that both surfaces 114*a* and 122*a* are being thermally heated by the physical contact to at least one heated platen. In response to the device 100 detecting that the first mold housing 108*a* and the second mold housing 108*b* are located a predefined distance apart (i.e., during heating of an ice ingot 110, housing 108*a* and 108*b* become closer together as compression and ice melt enable movement of the mold portions), the positioning means is configured to cause a downward movement of the lower platen assembly 122, the first mold housing 108*a*, and the second mold housing 108*b* to remove physical contact between the first mold housing 108*a* and the upper platen assembly 114 and to remove physical contact between the second mold housing 108*b* and the lower platen assembly 122. Additionally, or alternatively, physical contact may be removed upon detection that a predefined time period has expired or upon receiving user input to pause or stop a processing period.

The upper platen assembly 114 includes at least one channel (not shown) for receiving fluid therethrough (e.g., liquid water). The upper platen channel may function to receive a fluid therethrough in order to heat and/or cool components that may come into contact with one or more surfaces of the upper platen assembly 114. In some embodiments, the mold housing 108*a* may be placed in physical contact with the bottom surface 114*a* of the upper platen assembly 114 to thermally heat or cool the mold 108 to selectively melt and shape (or cool) an ice ingot held within the mold. In some embodiments, the thermal heating functions in combination with lower platen assembly 122 and mold housing 108*b*. Accordingly, the lower platen assembly 122 also may include at least one channel (not shown) for receiving fluid therethrough. The lower platen channel may function to receive a fluid therethrough in order to heat and/or cool components that may come into contact with one or more surfaces of the lower platen assembly 122. In some embodiments, the mold housing 108*b* may be placed in physical contact with the top surface 122*a* of the lower platen assembly 122 to thermally heat or cool the mold 108 to selectively melt and/or shape (or cool) an ice ingot held within the mold.

The channels described herein may accommodate a variety of fluid to heat or cool components in contact with surfaces of the platens described herein. For example, the fluid that may flow through the channels described herein may include tap water, demineralized water, deionized water, or otherwise processed water, coolant, fuel oils, heated chemicals, heated or cooled gases (e.g., Nitrogen, steam, etc.), or any combination thereof. The flow of the fluid may be metered, circulating, and/or pressurized within the channels. In some embodiments, heating of platens may be triggered through valves configured to plug into cooling or heating channels of the platens.

The heating station 102 may be configured to heat the platen assemblies 114 and 122 from about 30 to about 80 degrees Celsius. In some embodiments, the heating station 102 may be configured to heat the platen assemblies 114 and 122 to at least a temperature of about 40 degrees Celsius.

In some embodiments, the channels of each platen may not be used as a heating mechanism. Instead, induction heating of molds and/or mold portions may be employed to strategically melt and shape the ice ingot 110. In some embodiments, electrically charged coils may be placed in contact with platens 114 and 122 to heat the platens and transfer that heat to any or all portion of mold 108, for example. Other heating mechanisms are of course possible.

In general, an electronic heating mechanism 126 may function to generate heat for device 100. The heat may include electric heat, gas heat, or other liquid or fuel-based heat. The heat may be generated by heating liquids in mechanism 126 (and/or other piping system near or attached to device 100). The liquid may be heated and circulated via channels in the platens.

Upon completion of a heating step with heating station 102, the platen assemblies 114, 122 may be lowered and/or raised to be removed from physical contact to the mold 108. The transfer table 112 may then transfer the mold 108 (as well as any shaped ice therebetween any mold portions) to the cooling station 104. For example, when the molds are heated for a predetermined time (e.g., about 90 seconds to about 360 seconds), the platen assemblies 114 and 122 may open (e.g., platen 122 may move downward followed by mold 108 moving downward) and may place the mold 108 on the transfer table 112. In some embodiments, instead of an elapsed time, the device 100 may assess a proximity of mold portions (e.g., mold housing 108*a* and mold housing 108*b*) during a heating process or a degree or percent of ice melted. In such examples, the device 100 may be configured to release and retract platen assemblies 114 and 122 when the mold portions are detected to be a minimum distance apart. That is, as the ice ingot melts, the mold housing 108*a* may move toward mold housing 108*b* as platen assemblies 114 and 122 maintain tension on mold surfaces. The distance may be detected (e.g., optically, via proximity sensor, etc.) to determine when to release platens 114 and 122. The distance may also or instead be processor-detected based on a starting location of the mold 108 seated between the platens and a reoccurring measurement or determination of where the mold 108 or mold portions are located within in a vertical plane between surface 114*a* and 122*a*, for example.

In some embodiments, the transfer from the heating station 102 to the cooling station 104 may be triggered by a linear encoder which may be programmed to alert a processor associated with computing device 142 or controls 144 of a location of the mold 108, for example. The location may be used to determine when to transfer the mold 108 from the heating station 102 to the cooling station based on a recipe. The recipe may include cycles, timing, and shape details for shaping the ice ingot 110. The controls 144 may include a display device for displaying user interfaces 146 for interaction with a user and operations associated with the device 100.

The process of moving the platens and removing the mold 108 (or portions thereof) from any platen contact may function to remove the heat from the mold 108 in order to halt or slow the melting process of the ice ingot. Optionally, the transfer table 112 may then move the mold with the ice ingot to the cooling station 104. At this point, the ice ingot 110 may be at least partially shaped based on the heating of the mold at the heating station 102. However, the cooling station 104 may be optional and configurable for particular molds. Cooling the ice shapes after the heated shaping process may increase preservation of the desired shape. Alternatively, during the heating process, the heating may be reduced over time to slow the melt of the ice to preserve the desired shape of the ice.

If the device 100 is configured to use the cooling station 104, the mold 108 may be transferred from the heating station 102 to the cooling station 104 via the transfer table 112. The cooling station 104 may include at least a second upper platen assembly 132 disposed above a second lower platen assembly 134. As shown, the mold 108 with the ice ingot 110 is provided between platen assembly 132 and platen assembly 134. The second upper platen assembly 132 may include a housing 136 mechanically connected to a support structure 138. The support structure 138 may hold the platens 132 and 134 as well as any housings 136 and 140, such that at least two reciprocating shafts 128 and 130 may operate to move the platen assemblies 132 and 134 and mold 108 vertically up and down according to the direction shown by arrow 115. Thus, reciprocating shafts 128 and 130 may function as a second positioning means for controlling platen assemblies 132 and 134.

The upper platen assembly 132 and the lower platen assembly 134 may be configured to cool the mold 108 (or mold portions 108*a*/108*b*) based on a trigger event received by the positioning means. For example, a trigger event may include an arrival of mold 108 at cooling station 104 via table 112. In some embodiments, the trigger event is a sensor based trigger event (e.g., optical detection, motion detection, position detection, etc.). In some embodiments, the trigger event is computerized via computing station 106 based on a recipe. In general, the trigger event may cause a vertical upward movement of the mold housing 108*a* until at least one of the one or more surfaces (e.g., a top surface) of the first mold housing physically contacts the upper platen assembly 132 and at least one of the one or more surfaces (e.g., a bottom surface) of the mold housing 108*b* physically contacts the lower platen assembly 134.

The cooling of the mold 108 may begin during transport to the cooling station 104. The transport and subsequent cooling in the cooling station 104 provides an advantage of precision shaping because the time and subsequent cooling allows the mold 108 to continue to melt the ice ingot via heat energy stored in the mold based on thermal mass, but the melt is performed at a slower rate to avoid over melting while still allowing for some melt to shape the ice ingot 110 in the mold cavities of mold 108.

The platen assemblies 132 and 134 of the cooling station 104 may also include channels adapted to receive externally cooled fluid that may be circulated through the channels (not shown). In some embodiments, the platen assemblies 132 and 134 may instead be electrically cooled. In some embodiments, the processes of shaping ice described herein may be performed in a cooled room that is at or below zero degrees Celsius. In such examples, further cooling of the platen assemblies 132 and 134 may not be performed because the assemblies may be at a temperature that functions to cool any mold that comes into contact with the assemblies, for example, based on environmental temperature.

During transport of the mold or during cooling in cooling station 104, the assembly temperature triggers refreezing of the surface water on any ice ingot and/or shaped ice structures. Freezing surface water on the ice structures may avoid the formation of undesirable ice appendages (e.g., flat spots, pedestals), which may detract from an aesthetic appeal of the shaped ice.

In the example of FIG. 1, the positioning means/mechanisms may include one or more linear actuators. The linear actuators may include or otherwise control at least two vertical reciprocating shafts 118 and 120 for heating station 102 (at least two vertical reciprocating shafts 128 and 130 for cooling station 104). The linear actuators may be linked by shafts 118, 120 (or by shafts 128 and 130) and may be adapted to run through linear motion bearings (not shown) to move the platen assemblies 114 and 122 (or platen assemblies 132 and 134), and mold portions (e.g., mold assemblies 108*a* and 108*b*) described throughout this disclosure.

Although a single heating station 102 and a single cooling station 104 are shown, the device 100 may be configured with two heating stations 102 or a plurality of heating stations and a single cooling station 104 or a plurality of cooling stations. In such examples, shaped ice may be generated faster as the heating station processes may take longer than the cooling station processes.

The computing station 106 may include at least one computing device 142 that may function to operate a control station 144. In some embodiments, the computing device 142 may also function to operate the heating mechanism 126 and/or processes associated with mechanism 126. In some embodiments, the computing device 142 may include at least one processor and memory storing instructions to carry out processes on device 100 and/or on the devices described herein. In some embodiments, the computing device 142 may store recipes for shaping ice using liquids, heating steps, transfer steps, and cooling steps.

In some embodiments, the computing device 142 includes at least one processor and memory storing instructions that when executed cause the at least one processor device to generate and trigger display of at least one user interface (on a display associated with control 144) which may be configured to receive user input corresponding to a platen clamping metric, platen behavior, platen temperature, recipes for shaping ice ingots, mold size configurations and behavior, and mold shape metrics. The control 144 may also provide feedback to a user to indicate timing and completion status of a recipe being processed on device 100.

Upon completion of processing at heating station 102 and cooling station 104, the device 100 may have formed a plurality of sufficiently distinct ice shapes as defined by the plurality of mold cavities of mold 108. The sufficiently distinct ice shapes may be of any shape and size dictated by the mold. The ice shapes may be removed automatically at another station (not shown). In some embodiment's, the ice shapes may be removed via an ejector pin that may operate with the mold 108 to eject the ice shape out of the mold. In some embodiments, the ice shapes may instead be removed manually via devices configured to hold and move ice shapes. In some embodiments, ice may be post processed to be dried and/or polished and the like. In some embodiments, the shapes may be removed from a mold using a vacuum grasping tool configured to be connected to a pressurized vacuum which functions to suction the ice shape to the tool and from the mold as well as reverse the vacuum suction to release the ice shape. In some embodiments, removing ice shapes may be performed via various rotations and angling of the molds to encourage the ice shapes to dislodge from the mold cavities.

The platen assemblies described herein may be formed of aluminum to ensure fast platen heating times and slow platen cooling times. Platen structures such as platen assemblies 114, 122, (and/or platen assemblies 132 and 134) may be used to provide an advantage of a continuously heated metal plate that retains a constant temperature to avoid having to change the temperature of a large mass, which can cause fatigue and stress on components other than metal platens. However, other heating structures and materials are possible.

Figure 2A:
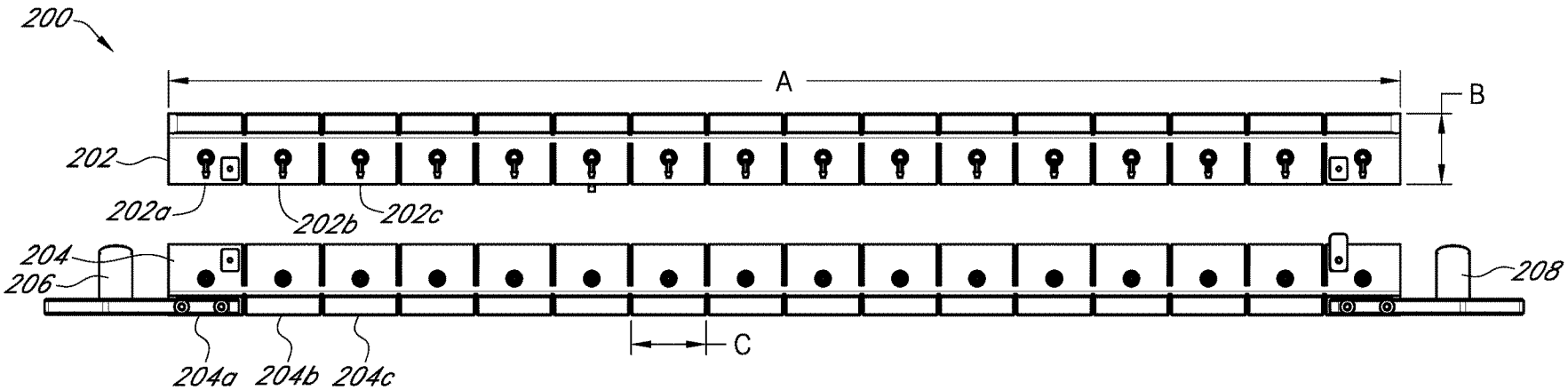
FIG. 2A illustrates a front view of an example assembly of an ice mold for use with the devices described herein.

FIG. 2A illustrates a front view of an example assembly 200 of an ice mold (e.g., mold 108) for use with the devices described herein. The assembly 200 includes a first mold housing 202 (e.g., such as mold housing 108*a*) and a second mold housing 204 (e.g., such as mold housing 108*b*). The first mold housing 202 is of length A, which may be about 0.5 meters to 1.5 meters. The first mold housing 202 is of height B, which may be about 2.54 centimeters to about 10 centimeters. The mold housing 204 may of the same height or may be of a different height. For example, if the mold cavities created by placing housing 202 in contact with mold housing 204 are of vertically symmetrical shape, then both housings 202 and 204 may be of the same depth. However, if the shape created by the merged mold cavities are not of a vertically symmetrical shape (or if there is not symmetry to the shape), the mold cavities 202 and 204 may be of a different height.

Figure 2B:
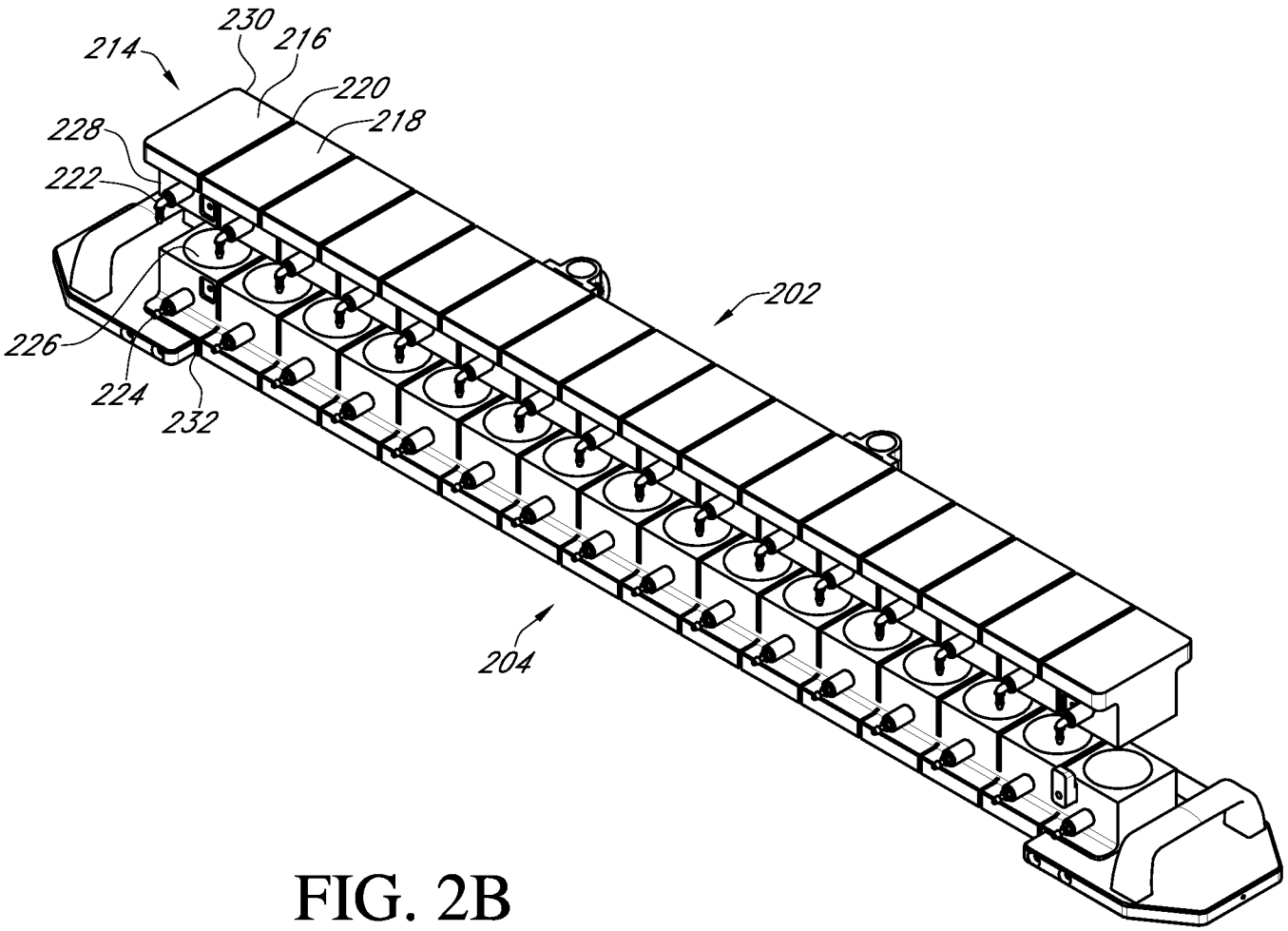
FIG. 2B illustrates a perspective view of an example assembly of an ice mold for use with the devices described herein.

The first mold housing 202 is of depth D, as shown in FIG. 2B. Depth D may be about 1.25 centimeters to about 8 centimeters. In some embodiments, the first mold housing 202 matches the length, width, and depth of the second mold housing 204 such that any cavities of the housings 202, 204 match up when placed adjacent. For example, when the housing 202 is stacked onto housing 204, the ice cavities (not shown in FIG. 2A) are configured to match and enclose to form ice structures upon melting an ingot between housing 202 and housing 204. In examples where the ice mold 108 is a single structure, the ice mold may be configured to be installed into device 100 and form ice structures according to the ice cavities of the single structure. In either example, many ice structures may be generated by a single mold regardless of how many structures make up the ice mold. Other depths are of course possible and the housing 202 may be of a differing depth than the housing 204.

The mold housing 202 includes a number of cavity structures 202*a*, 202*b*, and 202*c*, just to name a few examples. Additional cavity structures are shown along length A, but are not labeled for convenience of this description. The cavity structures 202*a*, 202*b*, and 202*c*, etc. may be configured to each house a portion of a shaped ice structure. For example, if the mold is for a spherically shaped ice structure, the number of cavities in the mold 200 dictates the number of spherically shaped ice structures that may be generated per cycle of the mold 200.

The mold structure 204 may also include a number of cavity structures 204*a*, 204*b*, and 204*c*, just to name a few examples. Additional cavity structures are shown in line, but are not labeled for convenience. The cavity structures 204*a*, 204*b*, and 204*c*, etc. may be configured to each house a portion of a shaped ice structure. For example, each cavity structure 204*a*, 204*b*, and 204*c* may be adapted to house the other portion of the ice structure intended for shaping in corresponding cavity structures 202*a*, 202*b*, and 202*c*. Each cavity structure 204*a*, 204*b*, and 204*c* (and in some embodiments cavity structures 202*a*, 202*b*, and 202*c*, etc.) may be of width C. Width C may be about 2.54 centimeters to about 15.3 centimeters.

As shown in FIG. 2A, the mold 200 includes a first handle 206 and a second handle 208. The handles 206 and 208 are adapted to be retrieved by machinery or a user in order to swap out the mold 200 for another mold.

FIG. 2B illustrates a perspective view of an example assembly 214 of an ice mold for use with the devices described herein. The assembly 214 includes the mold housing 202 and the mold housing 204. The mold housing 202 includes a number of top surfaces (e.g., top surface 216 and top surface 218). Other top surfaces are shown, but are not labeled for convenience of this description.

The top surfaces 216 and 218 are flat and adapted to be placed into contact with a platen assembly, such as platen assembly 114 and/or platen assembly 132. The assembly 214 may be made of a plurality of articulatable segments of cast aluminum where each segment of the mold assembly includes about a 0.6 centimeter relief (e.g., gap 220) therebetween. The gap 220 may provide an advantage of mold housing 202 (and mold housing 204) section movement to avoid distortions of the ice structures during heating and/or cooling. In some embodiments, articulating of the segments of the mold may provide an advantage of ensuring mold conformity to the platens to reduce air gaps between the cooled and/or heated mold portions and the platens.

In some embodiments, the molds described herein are semi-flexible (e.g., semi-rigid). The molds may include a plurality of pockets defining portion of cavities or entire cavities. Each pair of pockets may be disposed between an articulating joint to allow movement during heating or cooling of the ice ingot held by the mold. Allowing the sections to move (e.g., similar to vertebrae in the human body) allows for slight movement during expansion and contraction of the ice. The movement may also allow for improved thermal contact and heat transfer between the platens and the mold surfaces 216, 218, because platen surface to mold surface contacts ensure a maintained surface condition and efficient heating because any airgap is avoided because the mold sections may individually move.

Each mold cavity (or mold structure portion in multiportion molds) may include at least one outlet 222 (e.g., spigot) for draining liquid (e.g., water from melted ice ingot) from the cavity associated with the mold assembly 214. In general, the mold assembly includes a plurality of outlets 222, 224, etc., that are configured to drain liquid (e.g., water from melted ice ingot) from a plurality of cavities (e.g., such as example cavity 226) associated with the mold assembly 214. The liquid from the outlets (e.g., outlets 222, 224, etc.) may drain away from the mold and ice ingot to ensure that refreezing of shed water does not adhere to the mold assembly or ice ingot. In some embodiments such outlets may be linked together to drain into a single drain bin.

Figure 2C:
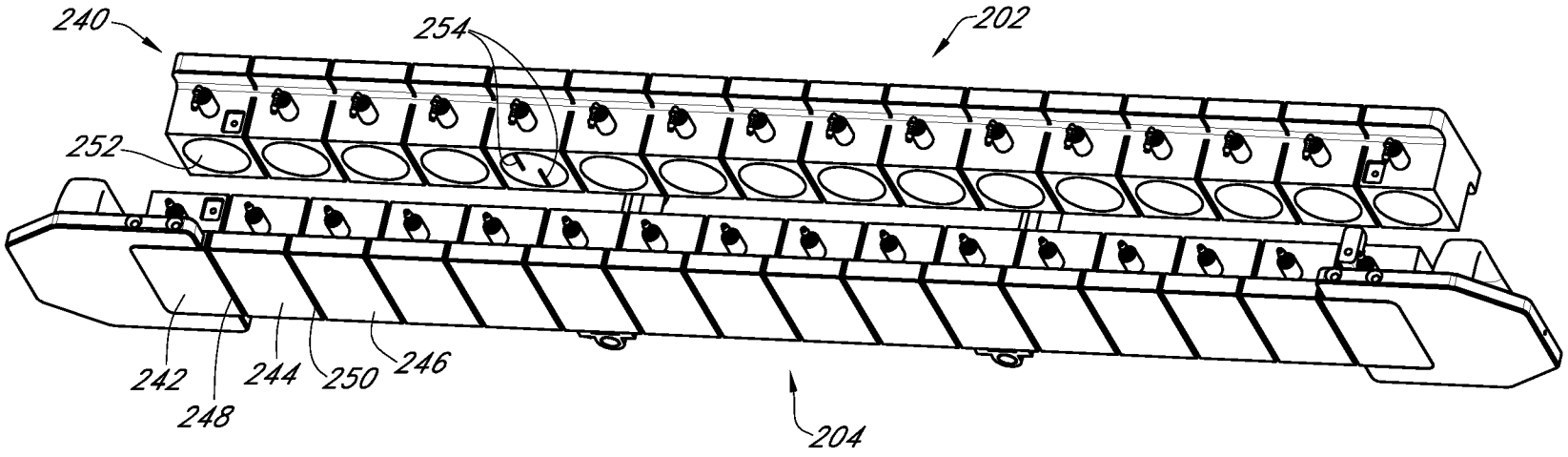
FIG. 2C illustrates another perspective view of an example assembly of an ice mold for use with the devices described herein.

Each mold housing 202 may have at least two side surfaces (e.g., surface 228 and surface 230) that are in contact with the top surface (e.g., 216). Each of such side surfaces (e.g., surface 228 and 230) of each cavity section may include a plurality of structures 254 (e.g., as shown in FIG. 2C) that extend into each of the plurality of mold cavities to hold the ice ingot. The structures 254 may function to ensure the ice ingot does not rotate during melting. Similarly, each second mold housing 204 may have at least two side surfaces that are in contact with the bottom surface (e.g., surface 232). Each of such side surfaces of each cavity section may include a plurality of additional structures (similar to structures 254) that extend into the plurality of mold cavities to hold the ingot.

FIG. 2C illustrates another perspective view of an example assembly 240 of an ice mold for use with the devices described herein. The assembly 240 again depicts mold housing 202 and mold housing 204. The mold housing 204 is shown with a number of mold surfaces (e.g., surface 242, surface 244, and surface 246, etc.) with a number of gaps (e.g., gap 248 and gap 250, etc.) shown between the surfaces 242, 244, and 246, etc.

In general, at least one of the one or more surfaces of the first mold housing (e.g., housing 202) and at least one of the one or more surfaces of the second mold housing (e.g., housing 204) defines a plurality of mold cavities e.g., cavity 252 defining a partial cavity of mold housing 202 and mold housing structure 204*a*) when placed in an adjacent position.

Figure 2D:
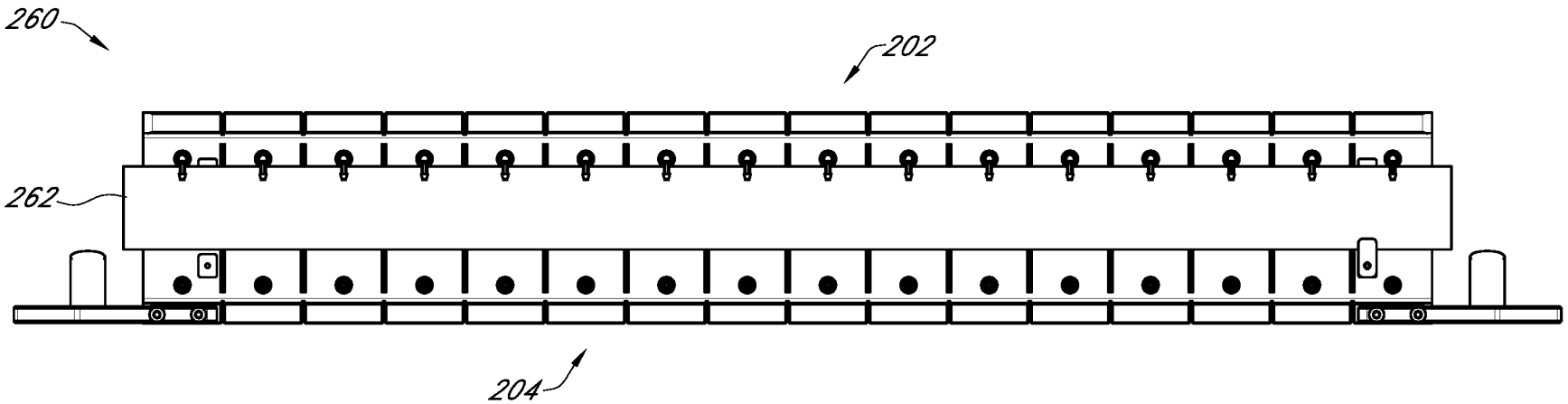
FIG. 2D illustrates a view of an assembly of the upper mold housing and the lower mold housing depicted with an elongate ingot of ice placed therebetween.

FIG. 2D illustrates a view of an assembly 260 of the upper mold housing 202 and the lower mold housing 204 depicted with an elongate ingot of ice 262 placed therebetween. The mold assembly 260 may be mounted to a support structure (not shown) and may include a plurality of mold cavities configured with a drain system for draining water, as described above.

Figure 3A:
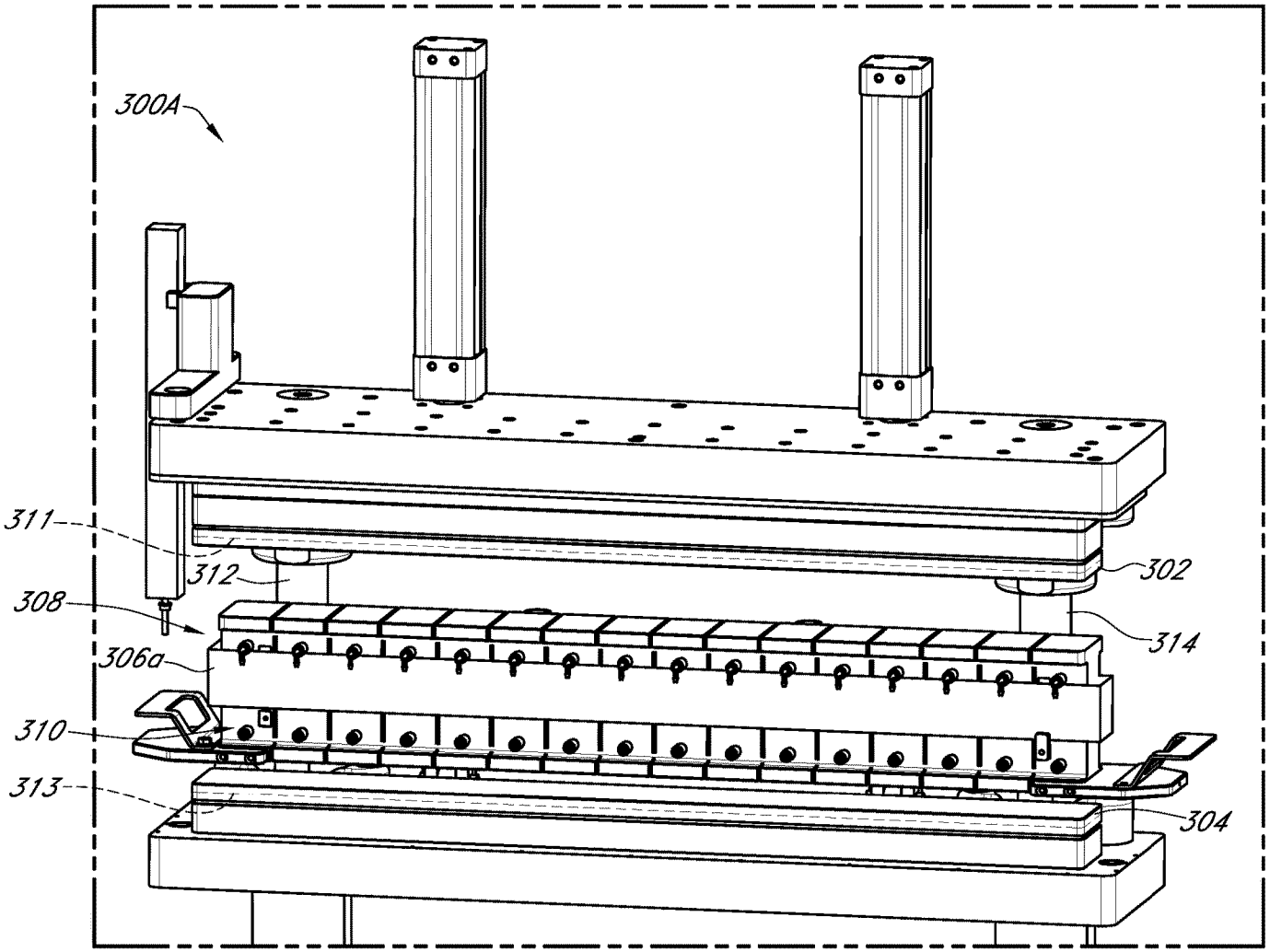
FIG. 3A illustrates an example view of a first platen assembly and a second platen assembly on a device for shaping an elongate ingot of ice.

FIG. 3A illustrates an example view 300A of a first platen assembly 302 and a second platen assembly 304 on a device for shaping an elongate ingot of ice 306. The assemblies 302 and 304 are configured to perform heating processes on a mold housing 308 and a mold housing 310 such that ice ingot 306 is shaped to form a plurality of spherical ice structures.

In this view, the mold housing 308 and the mold housing 310 have yet to clamp onto ice ingot 306. In some embodiments, assembly 302 may remain stationary while a linear actuator in communication with reciprocating shafts 312 and 314 may simultaneously or serially move portions of the device 100 depicted in FIG. 3A to begin heating processing. For example, a computing device (e.g., device 142) may trigger movement of the platen assembly 304 to meet the mold housing 310, trigger movement of the mold housing 310 to meet (e.g., physically contact) the ice ingot 306, trigger movement of the ice ingot 306 to meet the mold housing 308, and trigger movement the mold housing 308 to meet the platen assembly 302. In some embodiments, the platen assembly 302 may be configured to move downward to meet mold housing 308, for example. In the depicted example, the heating of the ice ingot 306 has not begun as indicated by spaces between ingot 306 and mold housing 308 and spacings between the mold housings 308 and 310 and respective platen assemblies 302 and 304. However, heating may be performed via channel 311 and channel 313 in platens when the mold housings 308 and 310 are placed in thermal contact with respect platen assemblies 302 and 304. In some embodiments, the channels (e.g., channels 311, 313, etc.) may be connected to an inlet and an outlet for each mold cavity, for example. The inlets and outlets may ensure uniform heating and cooling of the molds.

Figure 3B:
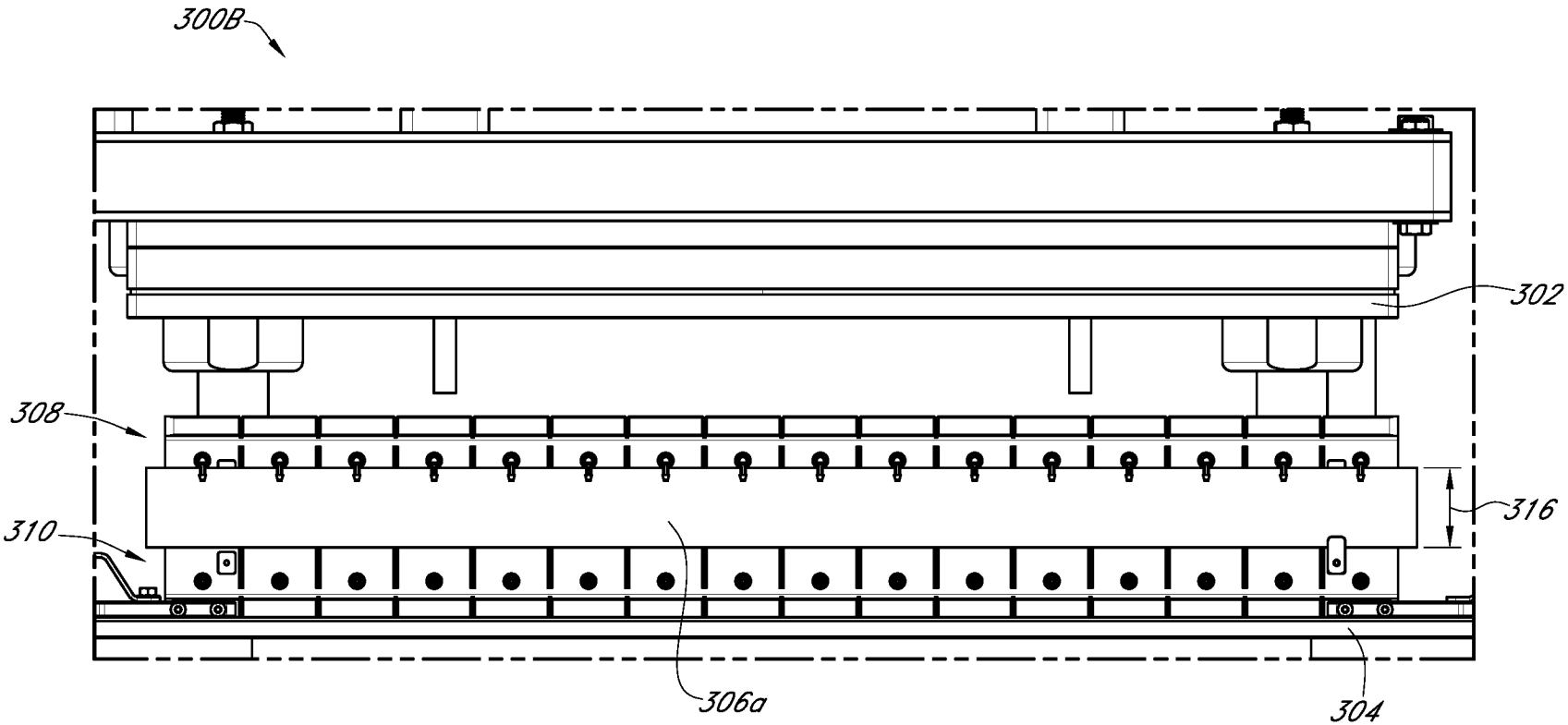
FIG. 3B illustrates an example view of the elongate ingot of ice placed between an example upper mold housing and an example lower mold housing for use with the devices described herein.

FIG. 3B illustrates an example view 300B of the elongate ingot of ice 306*b* placed between an example upper mold housing 308 and an example lower mold housing 310 for use with the devices described herein. The positioning means (e.g., reciprocating shafts 312 and 31) may have moved the platen assembly 304 upward into mold housing 310 while also moving mold housing 310 into the ice ingot 306*a*. In addition, the positioning means may have moved the ice ingot 306*a* into the mold housing 308 in order to secure the ice ingot 306*a*. The ice ingot 306*a* shown here at height 316 has yet to be heated or shaped by device 100. The device 100 has begun to move components together to begin heating the ice ingot 306*a*.

In operation of device 100 holding the assembly shown in view 300B, the positioning means (e.g., linear actuator via reciprocating shafts) may be configured to cause a vertical upward movement of the lower platen assembly 304 until the lower platen assembly 304 is in contact with the at least one of the one or more surfaces of the mold housing 310. The same positioning means may also be configured to cause a vertical upward movement of the mold housing 308 until the at least one of the one or more surfaces of the mold housing 308 contacts the first upper platen assembly 302. The mold housing 308 and the mold housing 310 are thermally heated based on the contact with the at least one of the one or more surfaces of the mold housing 308 and the upper platen assembly 302 and the contact with the at least one of the one or more surfaces of the mold housing 310 and the lower platen assembly 304.

Figure 3C:
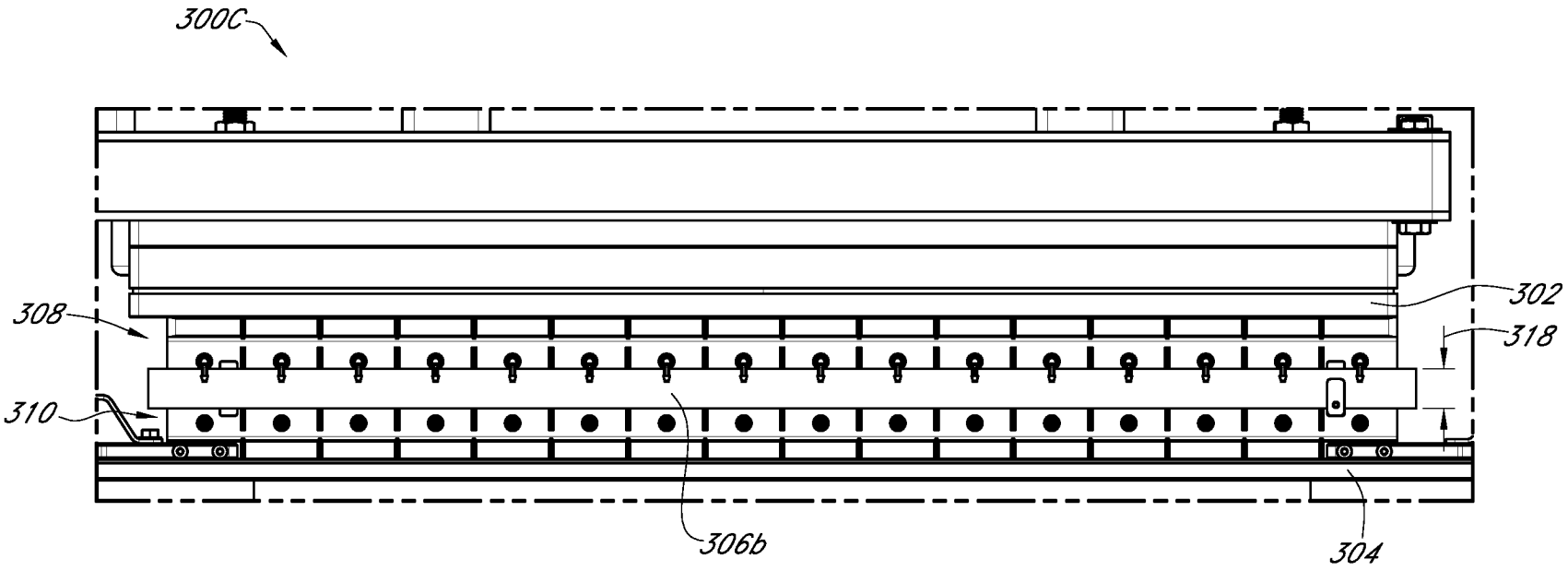
FIG. 3C illustrates an example view of the elongate ingot of ice supported by a mold during a heating phase associated with the devices described herein.

FIG. 3C illustrates an example view 300C of the elongate ingot of ice 306*b* supported by a mold (e.g., mold housings 308 and 310) during a heating phase associated with the devices described herein. For example, the device 100 triggered movement of components 304, 306*a*, 308, and 310 into place such that the mold housings 308 and 310 have begun to be heated based on the physical contact with respective platen assemblies 302 and 304. In this example, components 302, 308, ice ingot 306*b*, and components 310, and 304 are seated together with substantially no air gaps therebetween. The ice ingot 306*b* has begun to melt and be shaped within mold housings 308 and 310, as shown by the change in height from height 316 to height 318.

The mold housing 308 and the mold housing 310 are configured to maintain tension against the ice ingot 306*b*. The ice ingot 306*b*, placed here between the mold housing 308 and the mold housing 310, may be placed under tension to ensure mold conformity occurs during heating. In some embodiments, the tension is maintained to ensure the ice ingot 306*b* may be transported within device 100 or to another device. In general, the tension may be maintained during heating of the ice ingot 306*b* and removed upon detecting that the mold housing 308 and the mold housing 310 are located a predefined distance apart. The predefined distance may be defined by a recipe for shaping ice, for example, in which a minimum distance may be indicated in the recipe. When the device 100 detects the minimum distance between the two housings 308 and 310, the device 100 may trigger a next step in the recipe. In some embodiments, the next step is cooling. In some embodiments, the next step is ice structure removal.

Removing the tension from the ice ingot 306*b* may be performed by causing the positioning means (e.g., linear actuator via reciprocating shafts) to trigger a downward movement of one or both of: the lower platen assembly (e.g., assembly 304) and the mold housings 308, 310 to remove physical contact between the mold housings 308, 310 and the respective platen assemblies 302, 304.

Figure 3D:
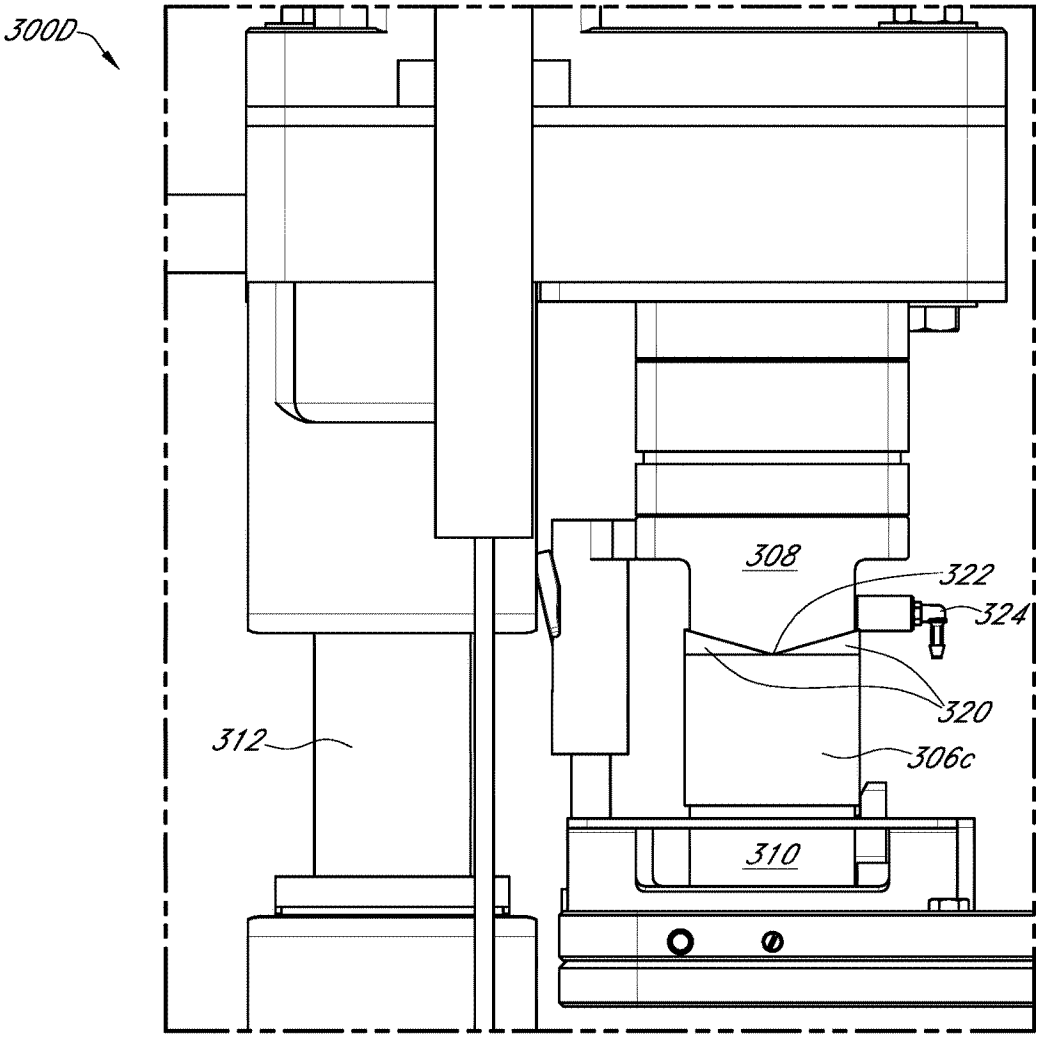
FIG. 3D illustrates a side view of the elongate ingot of ice supported by a mold during a heating phase associated with the devices described herein.

FIG. 3D illustrates a side view 300D of the elongate ingot of ice 306*c* supported by a mold (e.g., mold housing 308 and mold housing 310) during a heating phase associated with the devices described herein. In this example, the ice ingot 306*c* has begun to be shaped (e.g., strategically melted) to be formed into the plurality of distinct ice structure shapes associated with the mold cavities created when joining (or nearly joining) a bottom surface portion of mold housing 308 to a top surface portion of mold housing 310. As shown by ingot portions 320 and ingot divot 322, the mold housing 308 is beginning to shape the ingot 306*c* into a mold cavity shape. Water produced be melting portions of ice ingot 306*c* may be drained via one or more outlets (e.g., outlet 324). A side view of reciprocating shaft 312, for vertically positioning components of device 100, is also shown.

Figure 3E:
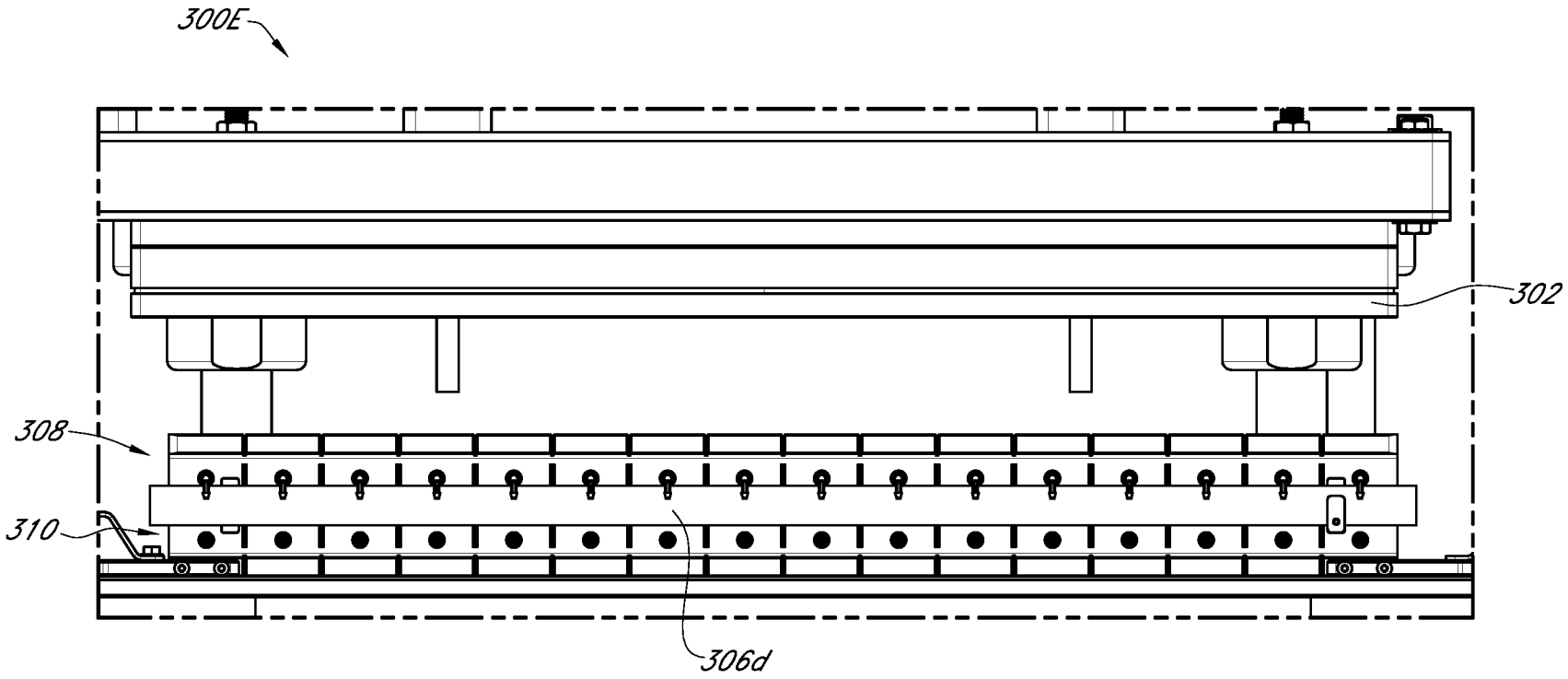
FIG. 3E illustrates an example view of the elongate ingot of ice supported by a mold after a heating phase associated with the devices described herein.

FIG. 3E illustrates an example view 300E of the elongate ingot of ice 306*d* supported by a mold (e.g., mold housing 308 and mold housing 310) after a heating phase associated with the devices described herein. In this example, the heating has been triggered to stop and in response, device 100 was triggered to drop or vertically move downward the housings 308 and 310 with the ice ingot 306*d* supported therebetween. The mold housings 308 and 310 along with the ice ingot 306*d* may be transferred to a cooling station, as shown in FIG. 4A.

Figure 4A:
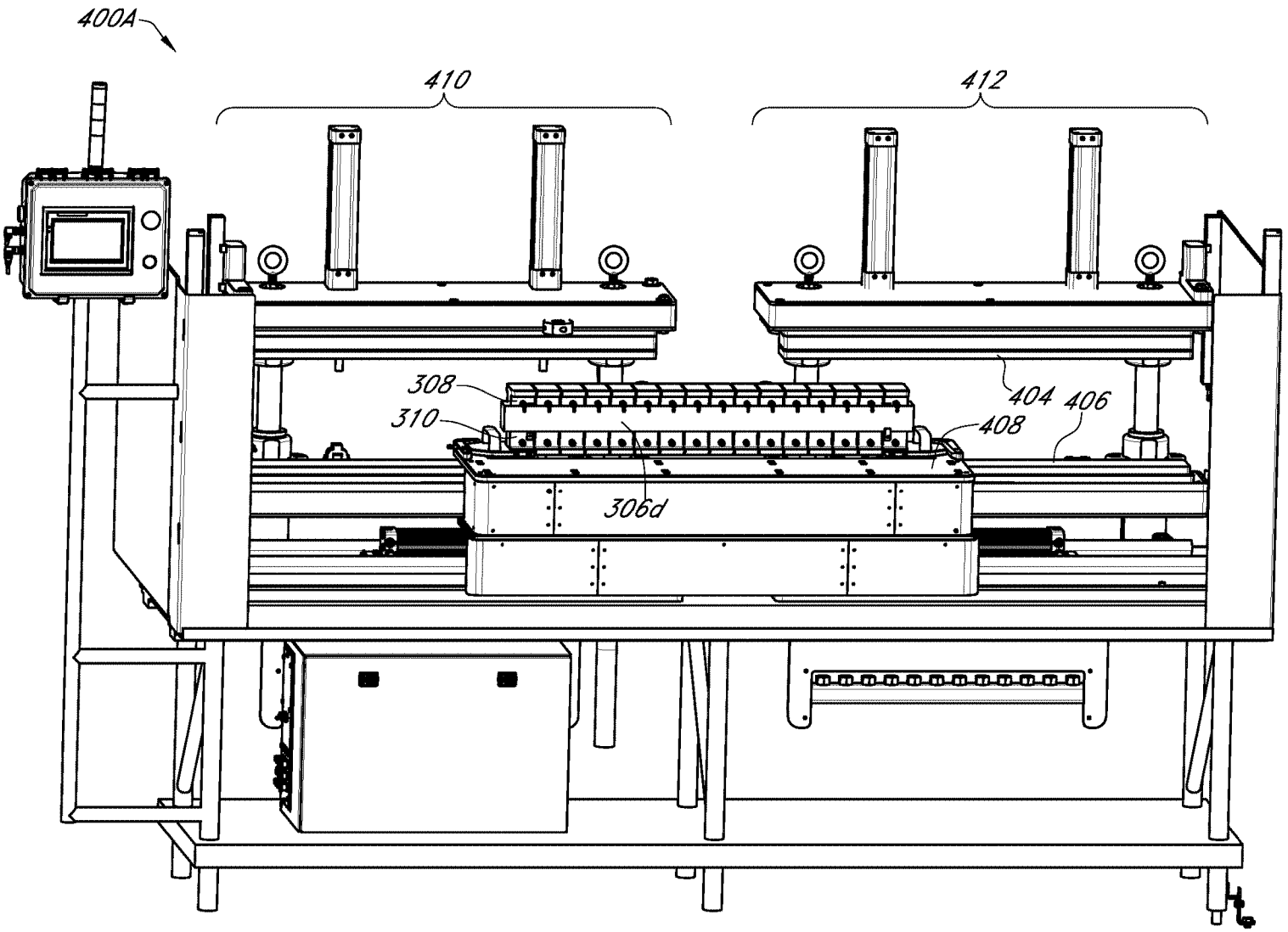
FIG. 4A illustrates an example profile view of transferring a mold with a shaped ice ingot from a set of heating platens to a set of cooling platens via a transfer table, for use with the devices described herein.

FIG. 4A illustrates an example view 400A of transferring a mold with a shaped ice ingot 306*d* from a set of heating platens (e.g., platen assemblies 302 and 304) to a set of cooling platens (e.g., cooling platen assemblies 404 and 406) via a transfer table 408, for use with the devices described herein. Here, the ice ingot 306*d* and associated mold housings 308 and 310 are shown part of the distance between a heating station 410 and a cooling station 412.

Figure 4B:
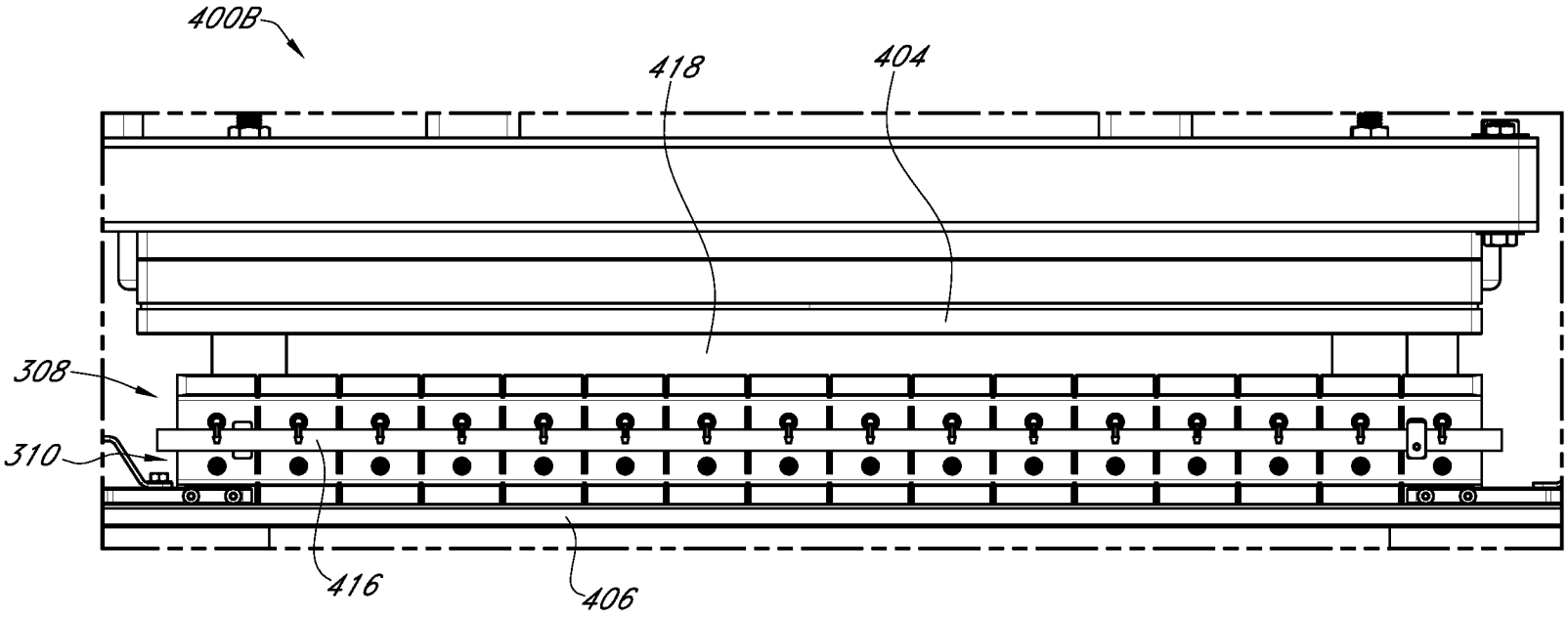
FIG. 4B illustrates an example profile view of a mold supporting the elongate ice after a heating phase and before a cooling phase associated with the devices described herein.

FIG. 4B illustrates an example profile view 400B of a mold supporting the elongate ice 416 after a heating phase and before a cooling phase associated with the devices described herein. In this example, the mold (e.g., housings 308 and 310) encases ice ingot 416 and has begun to raise the cooling platen 406 (not shown) along with mold housings 308 and 310 and ice ingot 416 toward cooling platen 404. Here, there is still a gap 418 shown between the mold housing 308 and the upper cooling platen assembly 404 indicating that active cooling has not yet begun.

Figure 4C:
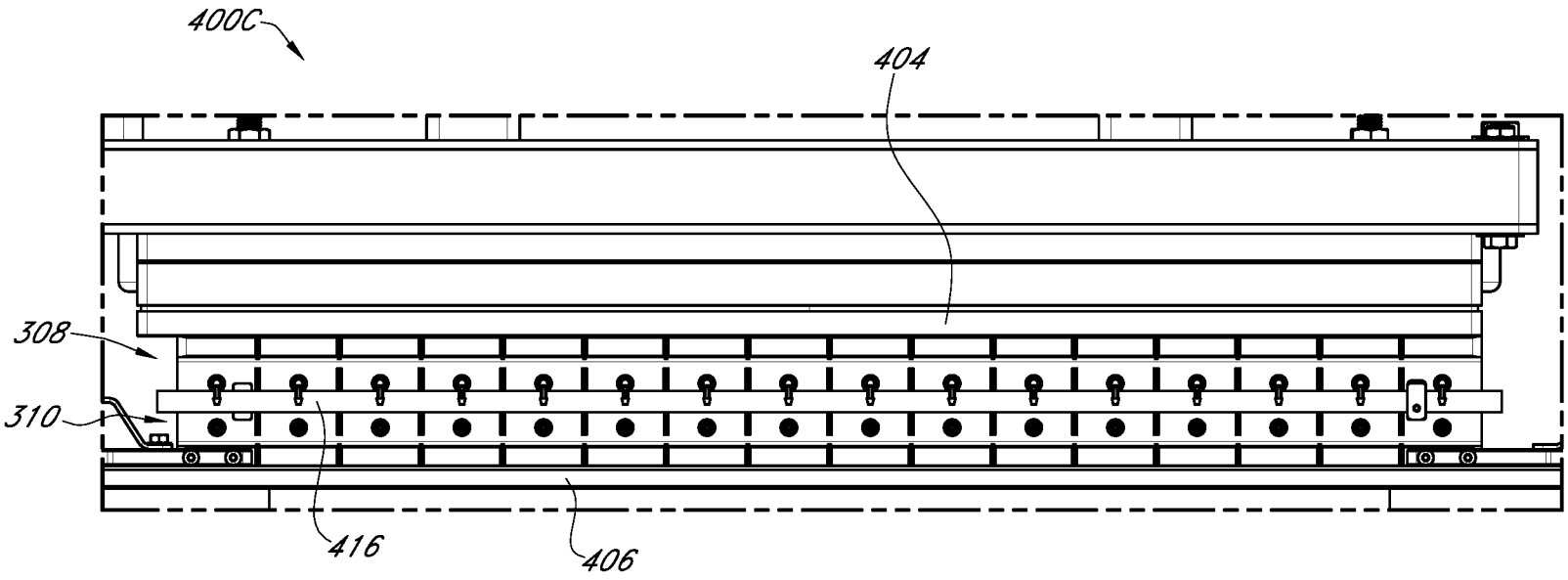
FIG. 4C illustrates an example view of a cooling phase of a mold supporting the elongate ice associated with devices described herein.

FIG. 4C illustrates an example view 400C of a cooling phase of a mold supporting the elongate ice 416 associated with devices described herein. In this example, the ice is being actively cooled because the bottom of mold housing 310 is in contact with lower cooling platen 406 while the top surface of mold housing 308 is in physical contact with upper cooling platen 404. The active cooling may occur for an elapsed amount of time based on a recipe executing on computing device 142, for example.

Figure 4D:
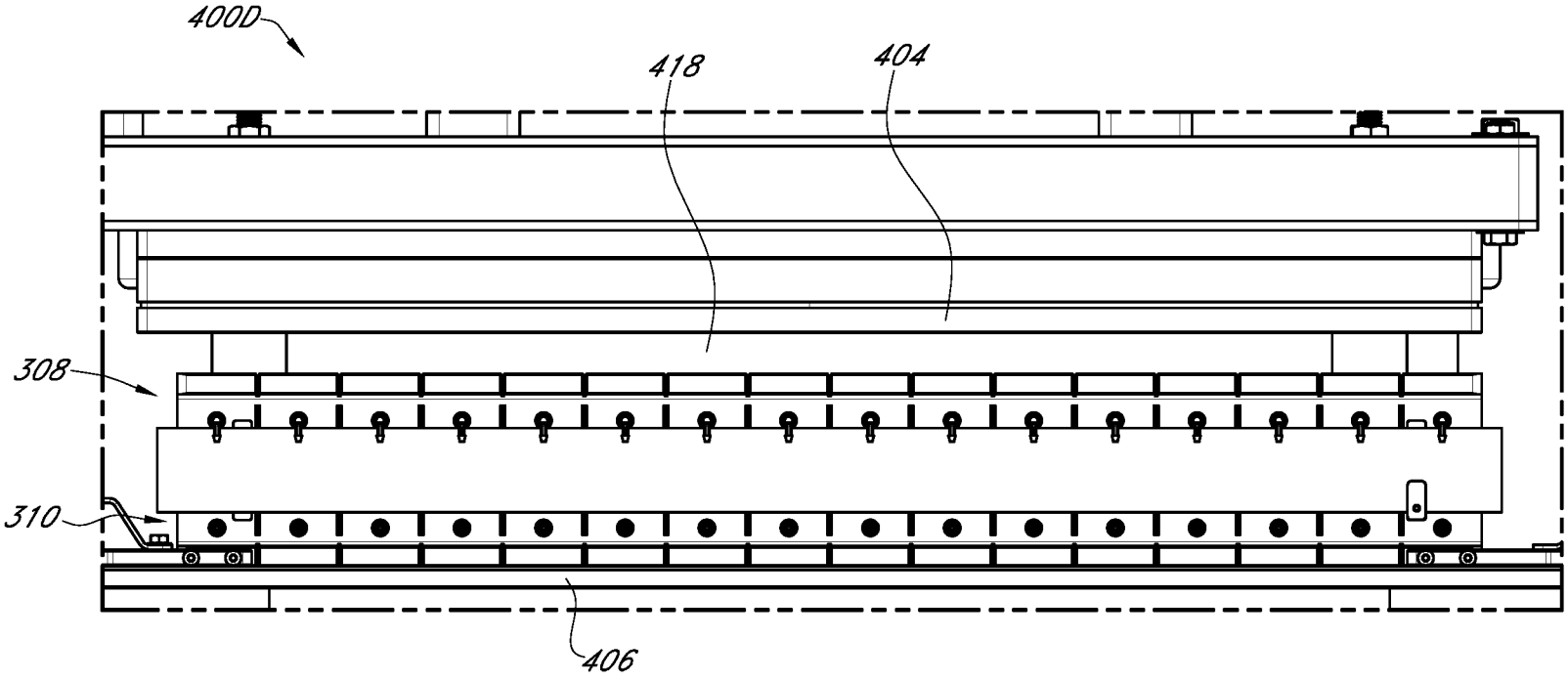
FIG. 4D is an example view of a mold supporting the shaped ice after a heating and a cooling phase associated with the devices described herein.

FIG. 4D is an example view 400D of a mold supporting the shaped ice (within the mold housings 308, 310) after a heating and a cooling phase associated with the devices described herein. Upon completion of the cooling phase, the device 100 may trigger platen assembly 406, and thus mold housings 308 and 310, to move downward to disengage both platen assemblies 404 and 406.

Figure 4E:
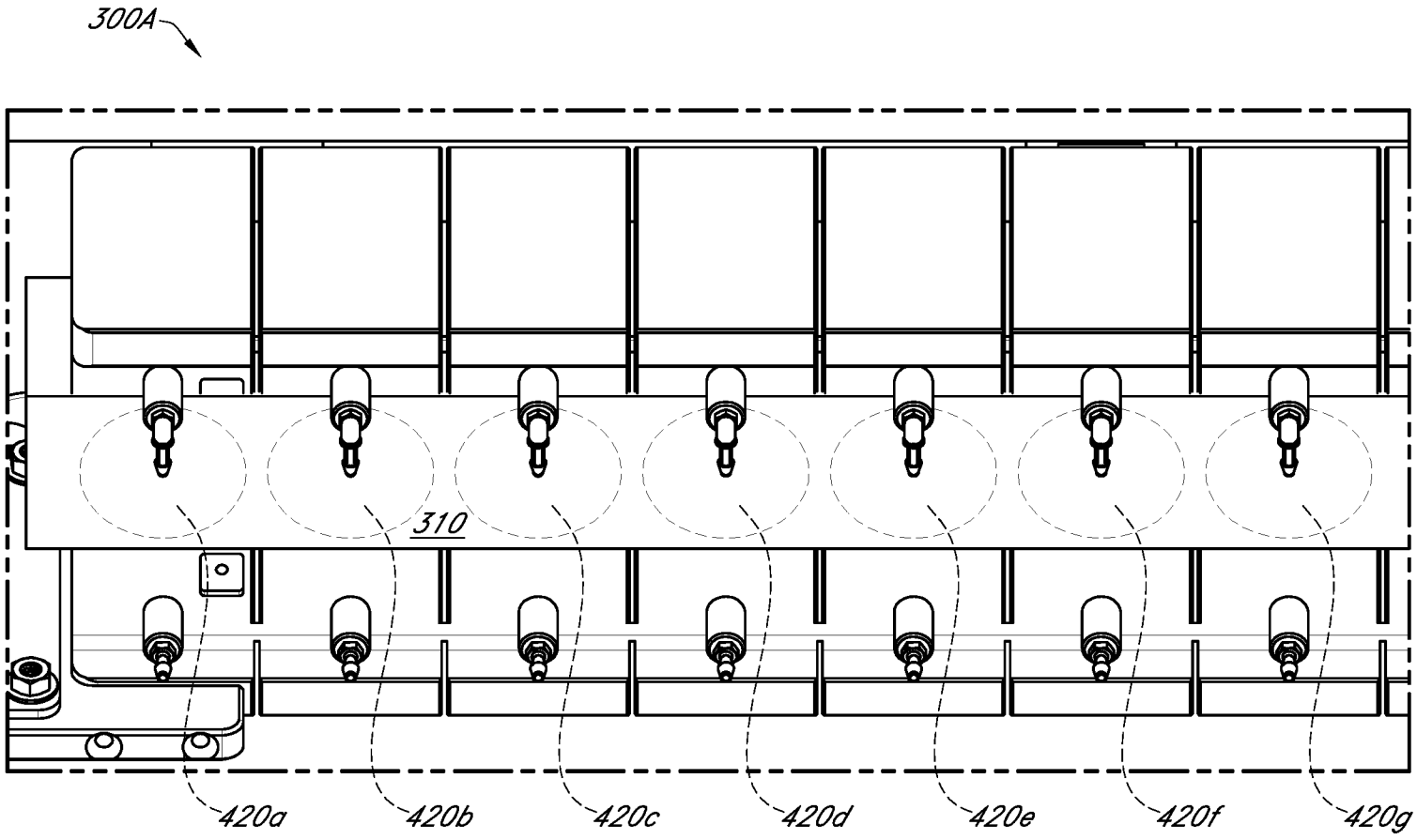
FIG. 4E is an example of spherically shaped ice structures generated by the devices described herein.

FIG. 4E is an example of spherically shaped ice structures 420*a-g* generated by the devices described herein. Spherically shaped ice structures 420*a-g* depict a portion of the structures generated by mold housings 308 and 310 for ease of viewing the shaped ice structures. A user or a machine may remove the ice structures from the mold housing 310, for example. The remainder of ice ingot 306*a* has been melted away and the ice structures 420*a-g* represent the resulting shaped ice.

Figure 4F:
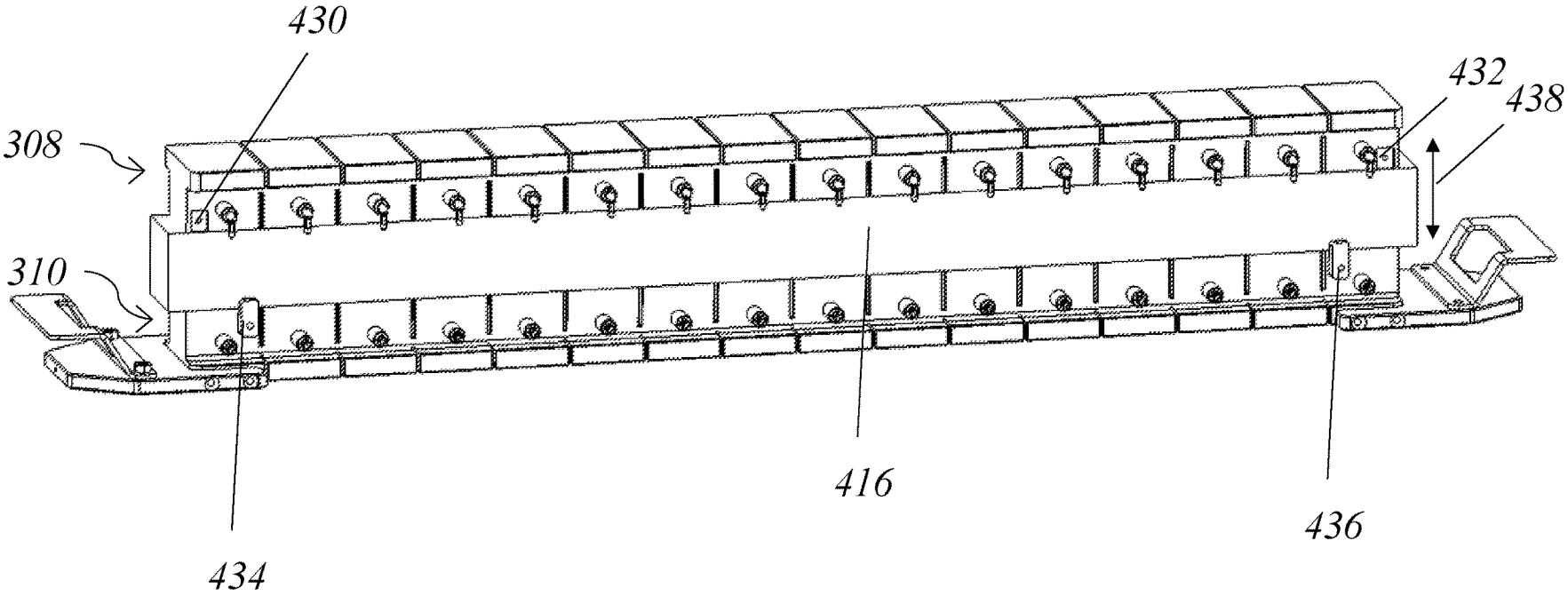
FIG. 4F is an example of a mold comprising one or more brackets for holding an ingot of ice in the mold.
Figure 4G:
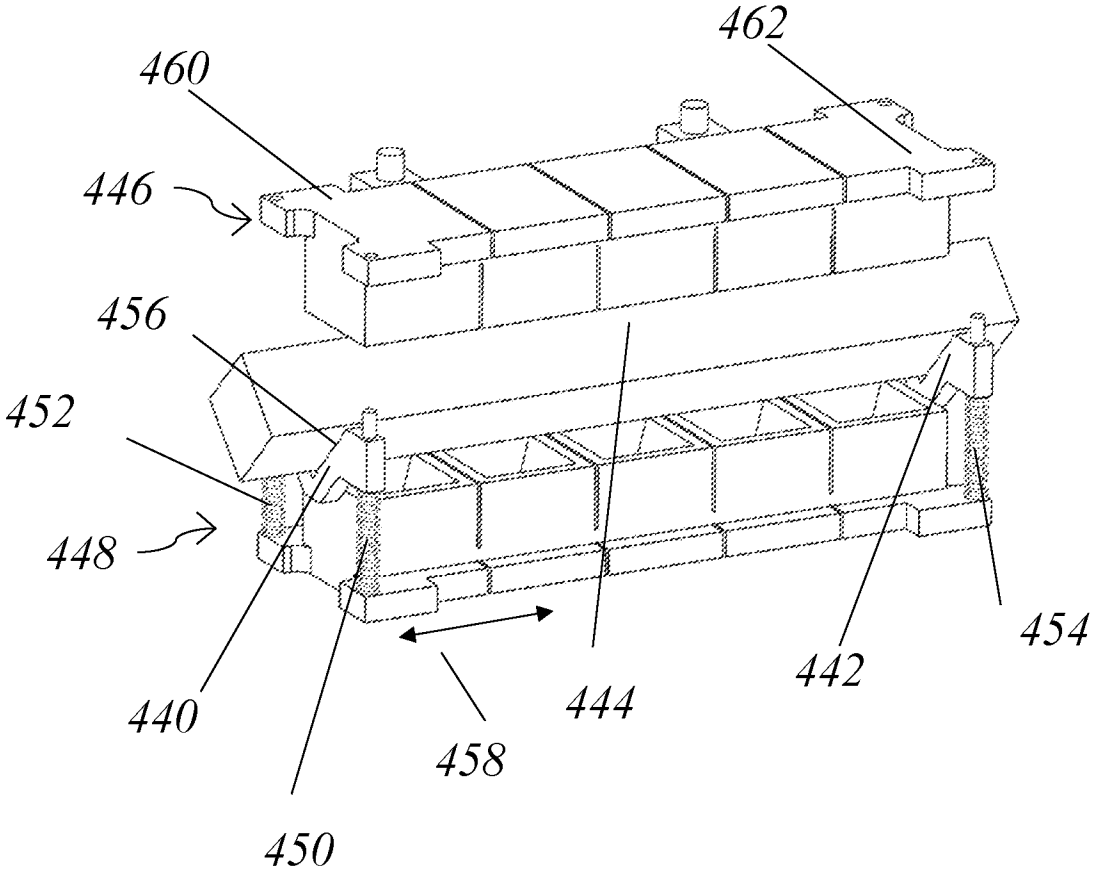
FIG. 4G is another example of a mold comprising one or more brackets for holding an ingot of ice in the mold.

FIGS. 4F-4G show examples of brackets for holding or supporting an ingot of ice in a mold. The brackets may be rigid or semi-rigid to accommodate and support one or more ingots of ice within a mold, for example, as the ingot is heated and cooled. Each upper and lower mold portion (or other mold portion for multipart molds) may include any number of brackets to support one or more portions of the ice ingot. In some embodiments, the brackets are fastened to mold portions and are fixed. In some embodiments, the brackets are fastened to mold housing portions that are configured to allow the brackets to be moved and/or located in any number of configurations and locations along the mold housing, for example to accommodate ingots of varying lengths.

FIG. 4F is an example of a mold comprising one or more brackets for holding an ingot of ice in the mold. As shown, the front view of the mold housing 308 (i.e., upper mold housing or portion) includes a first bracket 430 and a second bracket 432. The mold housing 308 may additionally include a third bracket (not shown). The third bracket may be placed on a back view of the mold housing 308 and against the ice 416 parallel to the first bracket 430. The mold housing 308 may additionally include a fourth bracket (not shown). The fourth bracket may be placed on a back view of the mold housing 308 and against the ice 416 parallel to the second bracket 432. Additional brackets similar to brackets 430 and 432 may be installed on mold housing 308. For example, one or more additional brackets may be positioned along portions of the mold housing 308 between bracket 430 and bracket 432 to support additional portions of the ice ingot 416 during processing.

The mold housing 310 (i.e., lower mold housing or portion) may also include brackets for supporting ice ingot 416. For example, front view of mold housing 310 includes a first bracket 434 and a second bracket 436. The mold housing 310 may additionally include a third bracket (not shown). The third bracket may be placed on a back view of the mold housing 310 and against the ice 416 parallel to the first bracket 434. The mold housing 310 may additionally include a fourth bracket (not shown). The fourth bracket may be placed on a back view of the mold housing 310 and against the ice 416 parallel to the second bracket 436. Additional brackets similar to brackets 434 and 436 may be installed on mold housing 310. For example, one or more additional brackets may be positioned along portions of the mold housing 310 between bracket 434 and bracket 436 to support additional portions of the ice ingot 416 during processing.

The brackets 430-436 may be fixedly attached to portions of mold housing 308 or 310 via a fastener. The fastener may affix each bracket 430-436 on a first end while allowing a second or free end of the respective bracket 430-436 to slide or otherwise engage with and support ice ingot 416. Thus, the bracket may be an elongate rectangle, ellipse, or other shape configured to be fastened at a first end and engage with an ice ingot at a second end.

In some embodiments, the brackets 430-436 may be fixed while the ice ingot 416 engages with the brackets 430-436. In some embodiments, the brackets 430-436 may be slidable in the direction of arrow 438 to engage with the ice ingot 416. For example, the brackets 430 and 432 are shown in a retracted position and are not engaged with the ice ingot 416.

The brackets 434 and 436 are shown in an extended position and are engaged with the ice ingot 416 to hold the ingot in place laterally.

The brackets described in FIG. 4F may be formed of plastic and/or polymers (e.g., polycarbonate, rubber, Delrin®, Acetal®, and the like) or other waterproof or water repellant material.

FIG. 4G is another example of a mold comprising a first bracket 440 and a second bracket 442 for holding an ingot of ice 444 in the mold. In this example, an upper mold housing 446 and a lower mold housing 448 are shown for molding ice ingot 444. The upper mold housing 446 includes brackets 460, 462, which are described in further detail below. However, in other embodiments, the upper mold housing 446 may not include the brackets such that brackets 440, 442 are configured to support an ice ingot.

The lower mold housing 448 includes the first bracket 440 seated on a first bracket pin assembly 450 and a second bracket pin assembly 452. Each pin assembly 450, 452 may include at least a pin and a spring around the pin to allow vertical movement of the brackets 440, 442. Similarly, the lower mold housing 448 includes the second bracket 442 seated on a third bracket pin assembly 454 and a fourth bracket pin assembly (not shown). The bracket pin assemblies 450-454 may fixedly attached to the respective brackets via through holes in the brackets. In some embodiments, the through holes may be adapted to tension fit the bracket pins without springs, for example, and may be seated via friction fit. In some embodiments, the bracket pins may include stops or threads to hold the brackets 440 and 442 in a position on the pins to enable and/or disable movement of the brackets 440 and 442 in a vertical direction.

The bracket pins 450, 452, 454 may engage with respective brackets 460, 462 on the upper mold mousing 446, such that the upper brackets 460, 462 include or define complementary grooves or apertures for receiving a bracket pin 450, 452, 454 therein. A location of the upper mold brackets 460, 462 may be adjustable or slidable to align them with bracket pins 450, 452, 454.

In some embodiments, the brackets 440 and 442 may be shaped to hold ice ingot 444 at an angle or corner rather than at a planar surface of the ingot 444. As shown, the brackets 440 and 442 are configured with a first surface 456 that is about 90 degrees to a second surface (not shown). Such an angle enables the ice ingot 444 to be held at about a 45 degree angle during processing.

The first bracket 440 and the second bracket 442 may be fixed or adjustable. As shown, the brackets 440 and 442 are fixed. However, the bracket pins 450-454 may be configured to slide along the mold housing 448 in the direction of arrow 458, for example, to engage brackets 440 and 442 at different locations along the ice ingot 444. Other angles are of course possible. Similarly, upper mold brackets 460, 462 may be similarly adjustable to allow for alignment between the upper brackets and the lower brackets.

The brackets 440 and 442 are shown as an L-shaped bracket. However, other brackets including other bracket shapes may be substituted based on ice ingot shape, ice mold cavity shape, mold housing constraints, and the like.

The brackets described in FIG. 4G may be formed of plastic and/or polymers (e.g., polycarbonate, rubber, Delrin®, Acetal®, and the like) or other waterproof or water repellant material.

Figure 4H:
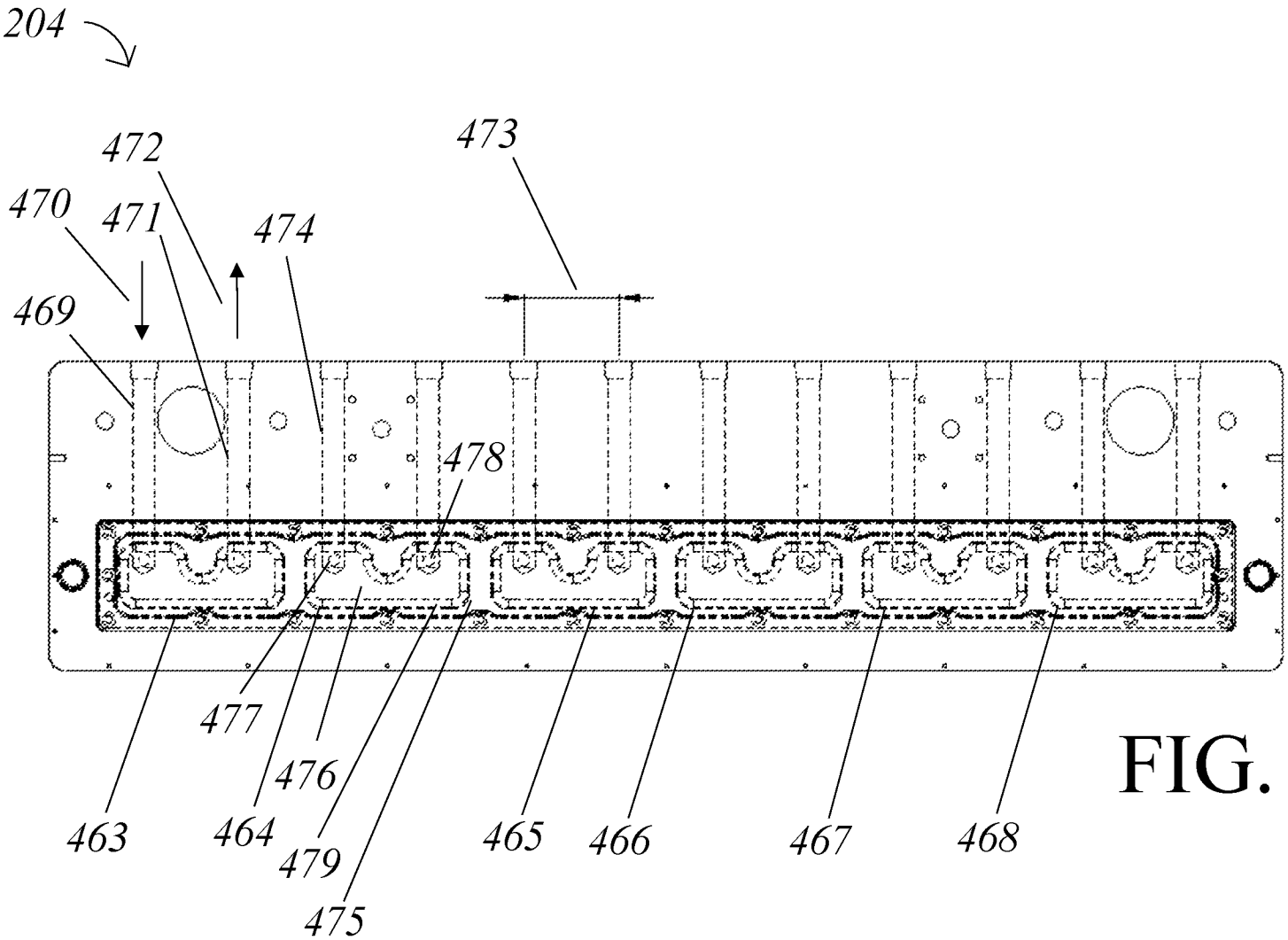
FIG. 4H illustrates an example top-down view of a mold with fluid channels.

FIG. 4H illustrates an example top-down view of a mold with fluid channels. The fluid channels may function as heat exchanger fluid channels to inflow and outflow fluid to cool and/or heat the particular mold housing the channels as well as cool and/or heat the content held within the mold cavities of the mold. For example, the fluid channels may function to heat and cool cavities and/or other surfaces of the mold. In some embodiments, the fluid channels may be evenly spaced across a length of a mold to ensure that heating and/or cooling of the mold and/or mold contents may occur without large temperature gradients between portions of the mold.

The example mold may represent mold 204, for example. In general, the mold 204 may include a plurality of fluid channels extending at least a portion of the length of the mold 204. As shown in this example, the fluid channels include a fluid channel 463, a fluid channel 464, a fluid channel 465, a fluid channel 466, a fluid channel 467, and a fluid channel 468. Each fluid channel within a mold may include an inlet and an outlet. The inclusion of an inlet/outlet pair for each fluid channel 463-468 may ensure that there is no substantial temperature gradient across a length of the mold 204 during heating and/or cooling. Such a temperature gradient may occur in conventional systems and may cause uneven melting (e.g., heating) or cooling (e.g., freezing) of an ice ingot within the mold. This temperature gradient may cause slowing of a cooling and/or heating process. Thus, unlike conventional systems, the fluid channels described herein may ensure an even (e.g., conformed) cooling and/or heating process occurs across the length of the mold.

As shown in FIG. 4H, the fluid channel 463 is formed into the mold 204. The fluid channel 463 is connected at a first location to a fluid inlet 469 to receive fluid input from a fluid source (not shown). The fluid input may flow in a first direction toward the fluid channel 463, as shown by arrow 470. The fluid channel 463 is also connected at a second location to a fluid outlet 471 to transfer fluid from the fluid cavity 463 to an output source (not shown). The fluid output may flow in a second direction away from the fluid channel 463, as shown by arrow 472.

The inlet 469 and outlet 471 for each fluid channel 463, for example, may be spaced about 74 millimeters to about 78 millimeters apart, as shown by indicator 473. In some embodiments, each fluid channel may also be spaced across a mold such that an outlet of a first channel (e.g., outlet 471 of channel 463) is spaced about 74 millimeters to about 78 millimeters from an inlet of a second channel (e.g., inlet 474 of fluid channel 464). Each additional channel may thus be spaced about the same distance from another channel to ensure consistent cooling and/or heating of the mold (or mold contents) via the channels 463-468.

The mold 204 may include a channel cavity portion 475 that includes the plurality of fluid channels 463-468. Each fluid channel 463-468 may include a core portion 476 for circulating fluid from inlet valve 477 and through outlet valve 478. Each fluid channel 463-468 may also include an outer perimeter 479. The core portion of the outlet valve 478 may include a plurality of surfaces to hold and/or circulate the fluid received from intake valve 477, for example.

The fluid channels 463-468 may be formed within the mold at a particular distance from a top and/or from a bottom surface of the mold. Although not indicated in the figures for clarity purposes, each fluid channel 464-468 may include similar features as fluid channel 463 and may operate in the same or similar fashion.

Figure 5A:
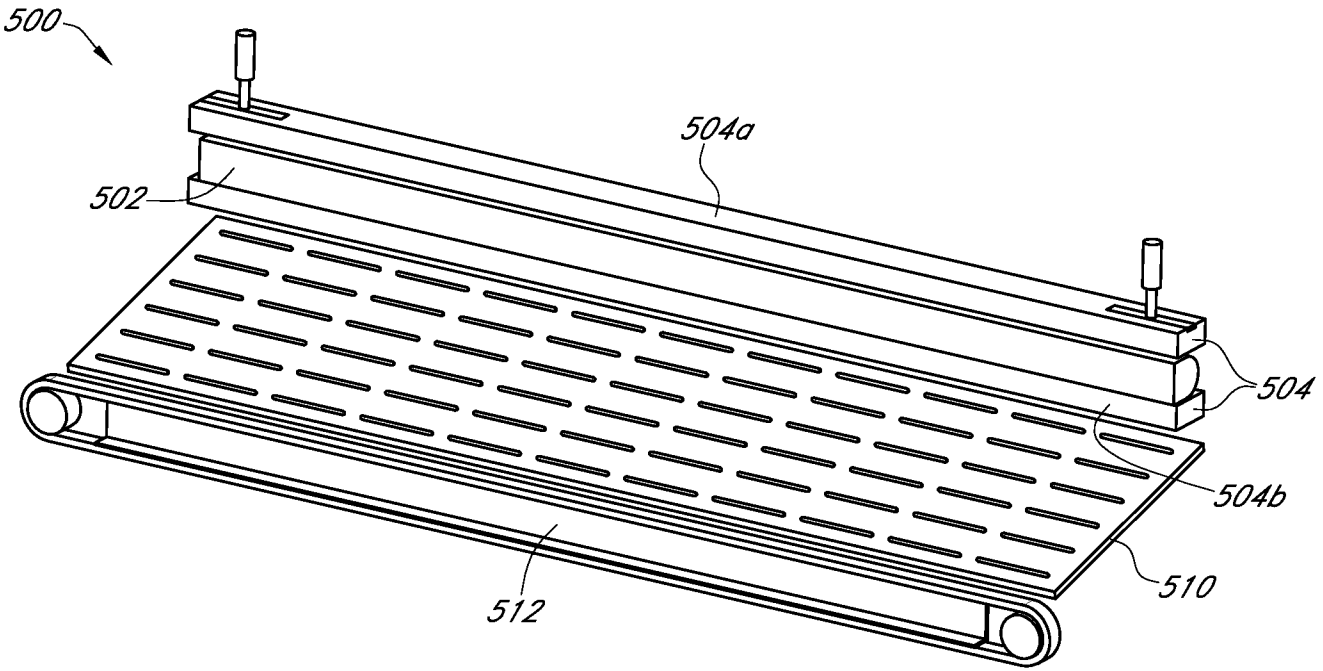
FIG. 5A illustrates an ingot of ice positioned on a device for shaping an ingot of ice.
Figure 5B:
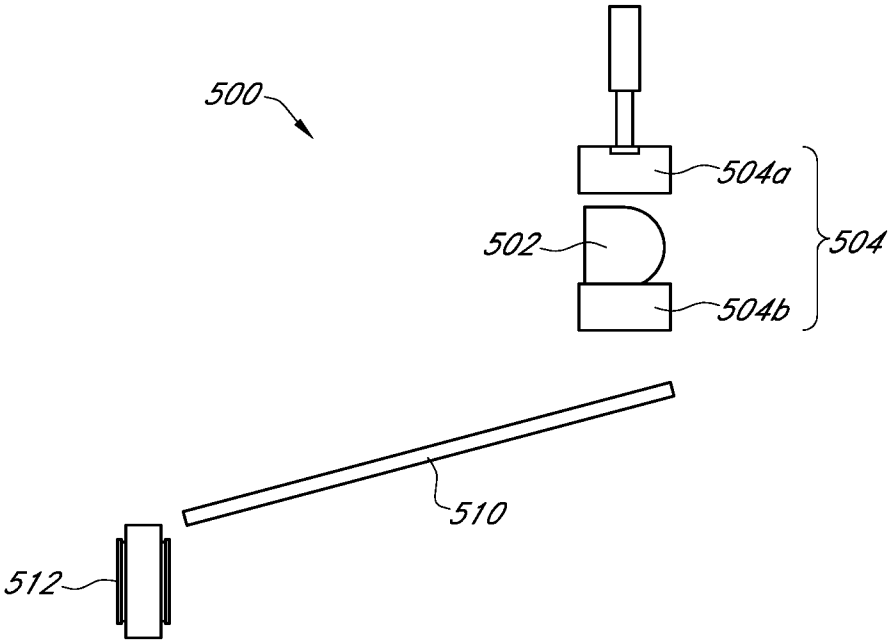
FIG. 5B illustrates a profile view of an ingot of ice positioned on the device for shaping an ingot of ice.
Figure 5C:
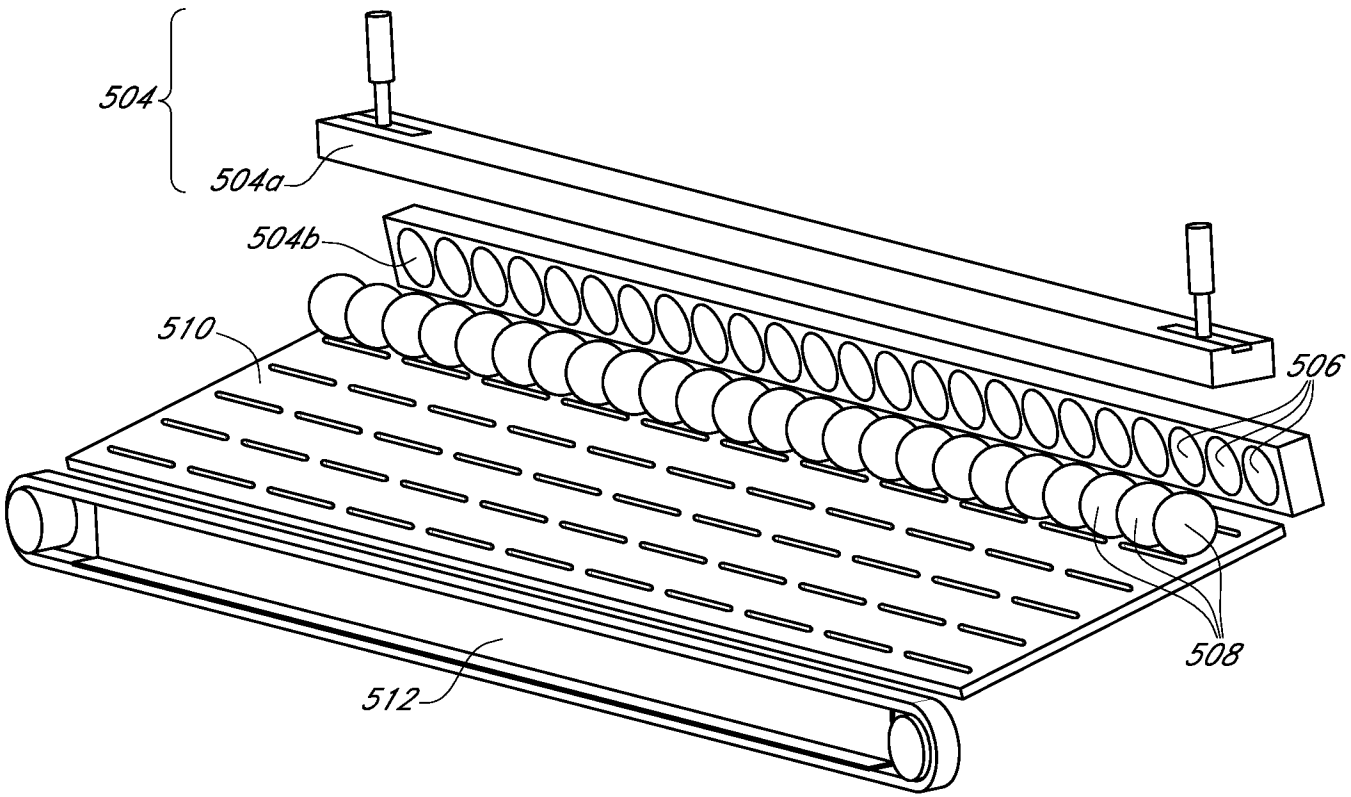
FIG. 5C illustrates a view of a device for shaping an ingot of ice emptying mold cavities after the completion of a shaping operation.

FIGS. 5A-C depict various views of a mold device 500 for shaping an ingot of ice 502 into a plurality of sufficiently distinct ice shapes 508 simultaneously. As shown in FIG. 5A, the device 500 can comprise a multipocketed heated mold 504 having an upper 504*a* and lower 504*b* portion that features a plurality of cavities (506, see FIG. 5C) in a reciprocal or corresponding relationship for shaping the ingot of ice. By "reciprocal" or "corresponding," it should be understood that each cavity (not shown) or partial cavity of an upper portion 504*a* is aligned with a cavity 506 (or partial cavity) of a lower portion 504*b* such that the two corresponding cavities define a desired shape. The defined shape can be any shape, regular or irregular and includes, but is not limited to, a cube, polyhedron, a sphere, a heart shape, a diamond shape, a clover shape, etc. In certain embodiments of the device 500, the cavities of the multipocketed heated mold 504 can be all the same shape or have different shapes. In further embodiments, multipocketed heated mold 504 can comprise more than two mold portions 504*a* and 504*b*.

In some embodiments, the ingot of ice has a cross-sectional profile that approximates at least a portion of the desired mold shape in order to reduce the amount of ice needed to melt to fit the mold 504, thereby improving efficiency, decreasing waste, and reducing the amount of time needed to shape the ingot of ice. In some embodiments, an ingot of ice having such a cross-sectional profile can be generated using a device of FIG. 1 as described herein having a suitable flume cross-sectional profile.

In various embodiments, one or both of the upper 504*a* and lower 504*b* portions can comprise strategically placed heating elements (not shown). During a shaping operation of the device 500, the upper 504*a* and lower 504*b* mold portions can apply gentle pressure and/or heat to a roughly fitted ingot of ice 502 according to a predetermined schedule such that the ingot of ice 502 is selectively melted to become a plurality of sufficiently distinct ice shapes 508, each having a shape corresponding to that of the desired shape of its mold cavity.

Returning to FIG. 5A, an ingot of ice 502 can be loaded onto the multipocketed heated mold 504 so that its dimensions predictably align with the arrangement of pockets 506. An ingot 502 can be loaded by a variety of means without deviating from the scope of this disclosure. In some embodiments, the ingot 502 is loaded manually by hand. In some embodiments, an automated conveyor system (not shown) can load an ingot 502 from a supply of ingots 502 into the device 500. FIG. 5B shows a cross-sectional or profile view of the same arrangement demonstrating this arrangement.

In various embodiments during a shaping operation of the device 500, one or both of 504*a* and 504*b* applies heat and/or pressure to the positioned ingot. In some embodiments, the lower portion 504*b* stays motionless while the upper portion 504*a* slowly presses down on the ingot 502 by pistons or another actuator. In many embodiments, liquid water produced by the melting of the ingot 502 is drained from the multipocketed heated mold 504 by a drain system (not shown).

In some embodiments, the multipocketed heated mold 504 additionally comprises or is in thermal communication with a cooling system capable of applying a refreezing temperature to the plurality of sufficiently distinct ice shapes 508 upon completion of a shaping operation of the device 500. Once the ingot 502 has been adequately shaped by the shaping operation, it can be important in certain embodiments to reapply a temperature equal to or less than the freezing temperature of the material of the ingot 502 in order to prevent any further melting that would deteriorate the desired shape. Furthermore, refreezing the plurality of sufficiently distinct ice shapes 508 also serves to dry them, which can also assist in their handling for any subsequent processing or packaging operations.

FIG. 5C depicts a view of the device 500 during an automatic removal of the plurality of sufficiently distinct ice shapes 508 from the multipocketed heated mold 504. In the embodiment of FIG. 5C, the lower portion 504*b* is adapted to rotate in order to dump the plurality of sufficiently distinct ice shapes 508 onto a loading incline 510 that delivers them to a conveyor 512 that can transport the ice shapes 508 to subsequent processing or packaging operations. In some embodiments, the plurality of sufficiently distinct ice shapes 508 can be removed manually by hand or automatically by other mechanisms.

In some embodiments, such as the embodiment of FIG. 5C, the plurality of sufficiently distinct ice shapes 508 are indeed fully separate and independent shapes of ice. Any further processing or packaging of the ice shapes 508 in this embodiment would need to account for the individual handling of each. However, in some embodiments, the multipocketed heated mold 504 can be adapted such that the plurality of sufficiently distinct ice shapes 508 are tethered to each other by a small bridge of ice forming what can be considered a sprue of sufficiently distinct ice shapes 508. In these embodiments, having the plurality of sufficiently distinct ice shapes 508 as a sprue can allow for the bulk handling of the plurality of sufficiently distinct ice shapes 508 in subsequent processing or packing operations. In many of these embodiments, the small ice bridges of a sprue of sufficiently distinct ice shapes 508 are adapted to be readily and cleanly severed when bulk handling is no longer desired.

Figure 6:
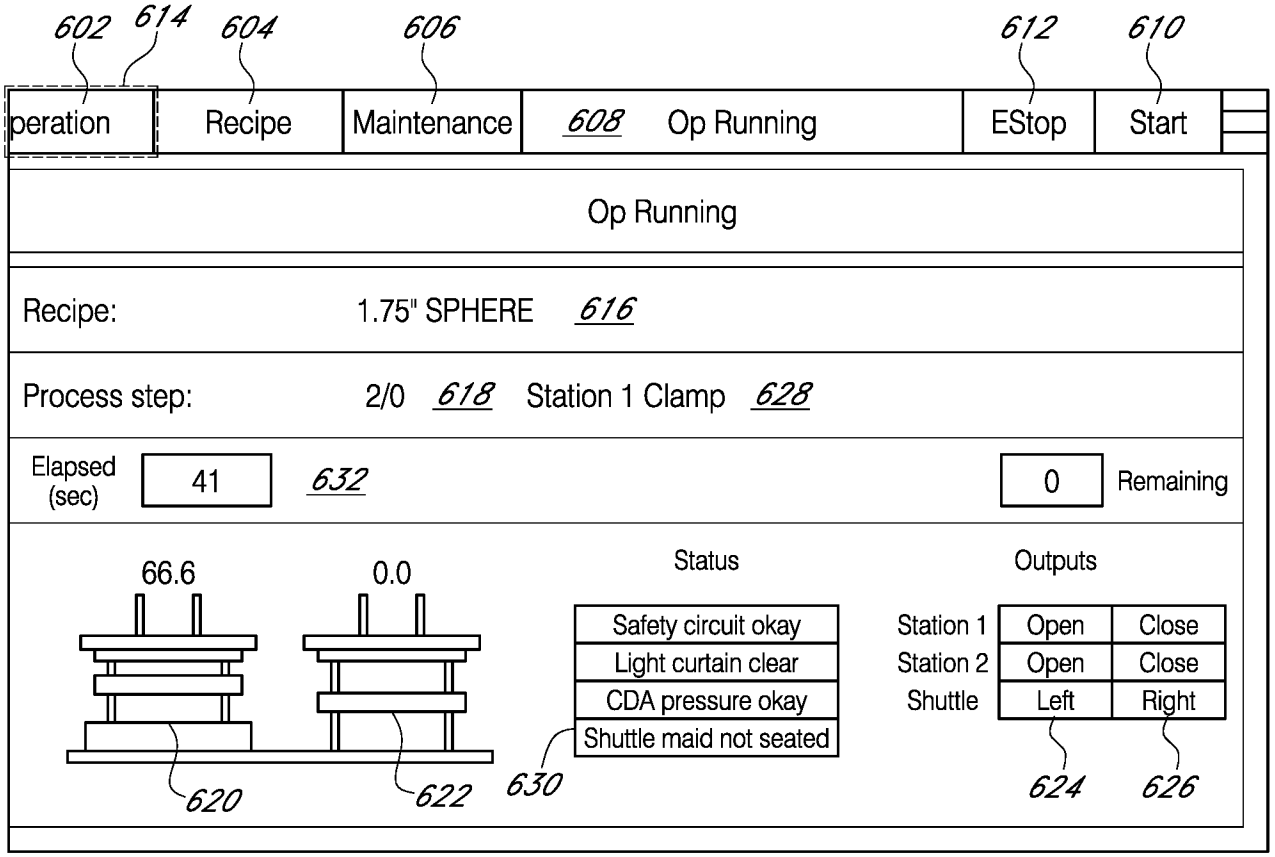
FIG. 6 illustrates an example user interface for operating the devices described herein.

FIG. 6 illustrates an example user interface 600 for operating the devices described herein. The user interface 600 may be generated by a computing device 142, for example, onboard device 100. In some embodiments, the computing device 142 may generate the user interfaces described herein based on communication with a network (not shown). The network may include the Internet and/or other types of data networks, such as a local area network (LAN), a wide area network (WAN), a cellular network, a satellite network, and the like. The network may also include (or have access to) any number of computing devices (or other ice processing devices) including, but not limited to computers, servers, routers, network switches, etc., any or all of which may be configured to received and/or transmit data within the network via hardwired and/or wireless connections. The computing systems describe herein may include or have access to one or more processors (not shown) formed in substrate, an operating system (not shown) and one or more memory devices (e.g., RAM, ROM, flash, cache, disk, tape, etc.). The computing device 142, for example, may include at least one processor and memory storing instructions that when executed cause the at least one processor device to generate and trigger display of at least one user interface.

The user interface 600 may be presented on device 144 (FIG. 1), similar to user interfaces 146. The user interface 600 may be configured to begin, modify, and end processes associated with ice shaping. For example, the user interface 600 includes a number of tabs that may be selected by a user to configure particular portions of processes associated with ice shaping. The tabs shown here include an operation tab 602, a recipe tab 604, and a maintenance tab 606. The user interface also includes a mode of operation, as shown by tab 608. Other tabs include a start tab 610 to start a process and a stop tab 612 to stop a process.

In this example, the operation tab 602 is selected, as shown by indicator 614. A shaping operation is executed on device 100 according to user interface 600. Before the shaping operation began, a recipe for a 1.75 sphere ice mold 616 may have been selected in recipe tab 604. The recipe includes two process steps, as shown by indicator 618. Pictorials 620 and 622 depict a status of stations (e.g., heating station 102, cooling station 104, and/or transfer table 112). In this example, pictorial 620 indicates the heating station 102 is currently in use while pictorial 622 indicates that the cooling station 104 is not in use. Other indicators (e.g., columns 624 and 626) may indicate further detail about components of the stations. In addition, an indicator 628 depicts which station is in use and which step of a shaping process is occurring. As shown, station 1 (e.g., the heating station 102) is in operation and currently performing a clamping step. Additional status indicators 630 may depict safety metrics. In this example, an indicator about a safety circuit and a light curtain status are shown along with a pressure indicator and an indicator of where the mold is with respect to shuttling between the stations. An elapsed time status indicator 632 depicts an elapsed length of time of the ice shaping process.

In general, the user interface may be configured to receive user input corresponding to a platen clamping metric (e.g., indicator 628), a recipe for shaping the ice ingot (e.g., via the recipe tab 604), a mold size (selected in the recipe tab 604, and a mold shape (selected in the recipe tab 604).

Methods

Figure 7:
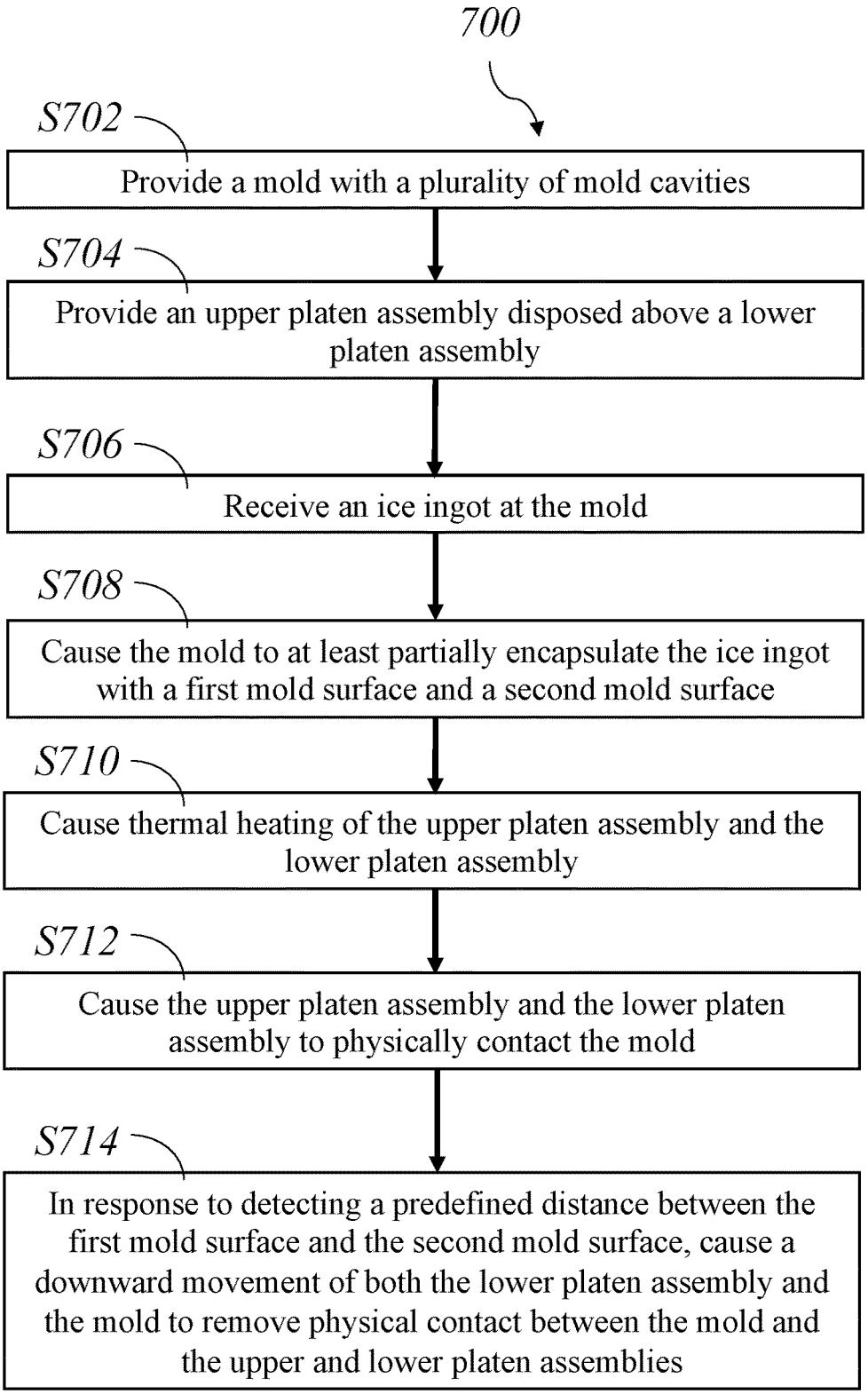
FIG. 7 is a flow diagram of a process for shaping ice.

FIG. 7 is a flow diagram of process 700 for shaping ice. At a high level, process 700 includes providing a mold with a plurality of mold cavities at Step S702, providing an upper platen assembly disposed above a lower platen assembly at Step S704, receiving an ice ingot in at the mold at Step S706, causing the mold to at least partially encapsulate the ice ingot with a first mold surface and a second mold surface at Step S708, causing thermal heating of the upper platen assembly and the lower platen assembly at Step S710, causing the upper platen assembly and the lower platen assembly to physically contact the mold at Step S712, and in response to detecting a predefined distance between the first mold surface and the second mold surface, causing a downward movement of both the lower platen assembly and the mold to remove physical contact between the mold and the upper and lower platen assemblies, at Step S714.

In Step S702, the process 700 includes providing a mold with a plurality of mold cavities. The process 700 may be performed on shaping device 100 (FIG. 1), for example, and may employ a single or multi-portioned mold, such as mold 108. The mold 108 (including mold housing 108*a* and mold housing 108*b*) is used as an example to illustrate the process 700. However, other mold types, shapes, and sizes may be substituted. In general, the molds described herein include a single pocket or are multipocketed. Multipocketed molds are configured to hold an elongate ice ingot that covers the pockets (e.g., ice cavities) and fills the ice cavities through a heating and cooling process of device 100, as described throughout this disclosure.

In some embodiments, the plurality of mold cavities is a shape selected from the group consisting of a cuboid shape, a polyhedron shape, a sphere shape, a heart shape, a diamond shape, a clover shape, a polygon shape, and a hemispherical shape. For example, a particular mold cavity of a single mold piece may include about 4 to about 5, to about 8 to about 10, or to about 20 separate distinct ice cavities. The shape of each ice cavity may be used to generate ice structures from a number of cavities to produce shaped ice having the shape of a plurality of cuboids, polyhedrons, spheres, hearts, diamonds, clovers, polygons, or hemispheres. Similarly, molds may be multi-pieced and may be abutted to form the ice cavities, as described herein.

In some embodiments, the mold 108 may be interchangeable with molds of a plurality of shapes and sizes. For example, if a spherical-cavity mold is used (as shown in FIG. 4E), a number of spherically shaped ice structures are produced. However, another mold may be of a similar length, but instead may include ice cavities in the shape of a clover (or other shape). The clover mold may be exchanged with mold 108 in device 100. The shaping of the ice with the clover mold would result in clover-shaped ice structures. In some embodiments, the mold may further include a drain system that drains liquid water from the plurality of mold cavities, as shown by example outlet 222 (FIG. 2B).

In Step S704, the process 700 includes providing a first upper platen assembly disposed above a first lower platen assembly. For example, the upper platen assembly 114 may represent the first upper platen assembly while the lower platen assembly 122 may represent the first lower platen assembly. Each of the first upper platen assembly (e.g., assembly 114) and the first lower platen assembly (e.g., assembly 122) include at least one heating mechanism. For example, the assemblies 114 and 122 may be heated via channels within the assemblies 114 and 122 or heated externally.

In some embodiments, the mold 108 is placed in device 100 and suspended between the first lower platen assembly 122 and the first upper platen assembly 114 by at least two vertical reciprocating shafts (e.g., reciprocating shafts 118 and 120). The platens may be configured to be moved by a positioning means such as at least one linear actuator.

In some embodiments, the first upper platen assembly 114 and the first lower platen assembly 122 each include a channel (e.g., such as respective channels 311 and 313 of FIG. 3A) to receive a flow of liquid. The liquid may be used to heat the platen assemblies 114 and 122 to heat the mold assemblies 108*a* and 108*b* via the channels 311 and 313. For example, the device 100 may cause the thermal heating of the first lower platen assembly 122 and the first upper platen assembly 114 to a predefined temperature, as described throughout this disclosure. Heating the platen assemblies 114 and 122 may include causing a flow of water through the at least one channel 313, 311 defined for each of the first lower platen assembly 122 and the first upper platen assembly 114. For example, the device 100 may trigger via recipe or user request, a flow of water through the channels 313, 311. In some embodiments, the water may be preheated by at least one heating mechanism associated with the first upper platen assembly 114 or the first lower platen assembly 122, such as electronic heating mechanism 126.

In some embodiments, causing the thermal heating of the first lower platen assembly 122 and the first upper platen assembly 114 to a predefined temperature comprises electronically heating the first lower platen assembly and the first upper platen assembly. For example, rather than using the channels 311, 313, the device 100 may instead heat the platens via electronic means. Similarly, rather than heat the platen assemblies 114 and 122, the device 100 may instead directly heat mold housings 108*a* and 108*b*.

In Step S706, the process 700 includes receiving an ice ingot in the mold. For example, ingot of ice 110 can be positioned according to an alignment of its dimensions with that of the device 100 or with the use of a digital vision system. In some embodiments, the ingot of ice 110 can be loaded manually by hand. In some embodiments, the ingot of ice 110 can be loaded automatically by a conveyor system (not shown) or another mechanism. In general, receiving the ice ingot 110 includes aligning the ice ingot 110 such that the mold housing 108*a* and 108*b*, in FIG. 1, retains tension on the ice ingot 110 to avoid slippage of the ice ingot 110.

In Step S708, the process 700 includes causing the mold to at least partially encapsulate the ice ingot. For example, the mold may have ridges, lips, and/or holds that extend from the edges of the ice cavities to encase one or more surface portions of the ice ingot 110. The mold housing 108*a* and mold housing 108*b* may be sized to hold an elongate ice ingot 110 under tension during heating and cooling steps.

In Step S710, the process 700 includes causing thermal heating of the first lower platen assembly 122 and the first upper platen assembly 114 to a predefined temperature. For example, the heating station 102 may be configured to heat the platen assemblies 114 and 122 from about 30 to about 80 degrees Celsius. In some embodiments, the heating station 102 may be configured to heat the platen assemblies 114 and 122 to at least a temperature of about 40 degrees Celsius. The predefined temperature may be selected according to a recipe, a mold, or other user-requested entry via control 144, for example.

In Step S712, the process 700 includes causing the first upper platen assembly 114 to physically contact at least a first mold surface 216, 218, etc. (e.g., an entire top surface of mold housing 202) of a mold (as shown by mold 214) while causing the first lower platen assembly 122 to physically contact at least a second mold surface 242, 244, 246, etc. (e.g., an entire bottom surface of mold housing 204) of the mold (as shown by mold 240). Each physical contact may trigger selective heating of the ice ingot 110 for example, for a predefined time period, such that the ice ingot selectively melts to form a plurality of sufficiently distinct ice shapes as defined by the plurality of mold cavities (e.g., cavity 252 and the like as well as cavity 226 and the like).

In Step S714, the process 700 includes causing a downward movement of both the first lower platen assembly 122 and the mold 108 to remove the physical contact between the first mold surface (e.g., the entire top surface of mold housing 202) and the first upper platen assembly 114 and to remove the physical contact between the second mold surface (e.g., the entire bottom surface of mold housing 204) and the first lower platen assembly 122 in the example where the mold depicted in FIGS. 2A-2D were to be installed within heating station 102 of device 100.

The downward movement may be caused in response to detecting that the first mold housing and the second mold housing are located a predefined distance apart. For example, the device 100 may optically, mechanically, or via recipe instructions determine that enough melting has occurred of ice ingot 110 because the top mold housing 108*a* and the bottom mold housing 108*b* are a predefined distance apart. The predefined distance may be defined according to a desired ice cavity outcome. For example, if the ice cavities are spherical, the recipe may indicate that a predefined distance between the two mold housings 108*a*, 108*b* is to be about one to about two millimeters such that the resulting ice shapes are spherically shaped with each of the plurality of sufficiently distinct ice sphere shapes being separate, individual volumes of ice while each of the plurality of sufficiently distinct ice sphere shapes are tethered together by an ice bridge to form a sprue of ice shapes. The predefined distance may be made sufficiently small so as to quickly break the sprue when harvesting the spheres of ice.

In some embodiments, the downward movement may instead be caused by the elapsing of a predefined amount of time, as defined in a recipe, for example. The elapsed amount of time may be based on initial measurements of platen temperature, for example, and/or may take into account process anomalies that occur during recipe processing. That is, if a temperature of one or both platen assemblies was determined to be below recipe instructions, the device 100 may increase the processing time for the recipe to ensure the outcome results in the spherical ice with the intended sprue.

In some embodiments, the process 700 may include additional processing steps. For example, the recipe and/or device state may trigger additional post processing steps on the plurality of sufficiently distinct ice shapes. In one example, at least one post processing step may include selectively cooling the ice ingot to refreeze surface water associated with the ice ingot. For example, the heated ice mold 108 may be transferred to the cooling station 104. In particular, the device 100 may cause horizontal movement of the mold 108 (which is housing the heated ice ingot 110 therein). The horizontal movement of the mold 108 may be via a transfer table (e.g., transfer table 112), so that the mold is suspended between a second upper platen assembly 132 disposed above a second lower platen assembly 134.

In some embodiments, the process 700 further includes using the cooling station 104 to further cool the mold 108 and ingot 110 by causing the second upper platen assembly 132 to physically contact at least one mold surface (e.g., surfaces 216, 218 and/or the entire top surface) of the first mold housing 202 while causing the second lower platen assembly 134 to physically contact at least one mold surface (e.g., surfaces 242, 244, 246 and/or the entire bottom surface) of the second mold housing 204. Each physical contact may trigger cooling of the mold via platen assemblies 132 and 134.

In some embodiments, the device 100 may trigger removal of the plurality of sufficiently distinct ice shapes from the mold 108 in response to detecting that the mold 108 meets a predefined temperature threshold. For example, after cooling the mold 108 in cooling station 104, the device 100 may determine that any of the surface water has again frozen by measuring the temperature of the mold over time.

In some embodiments, the device 100 may trigger removal of the cooling platens from the respective molds after a predefined period of time has elapsed. For example, in response to cooling for a predefined period of time, the device 100 may be programmed to cause the second upper platen assembly and the second lower platen assembly to move to remove the respective physical contacts and may remove the plurality of sufficiently distinct ice shapes from the mold.

Figure 8:
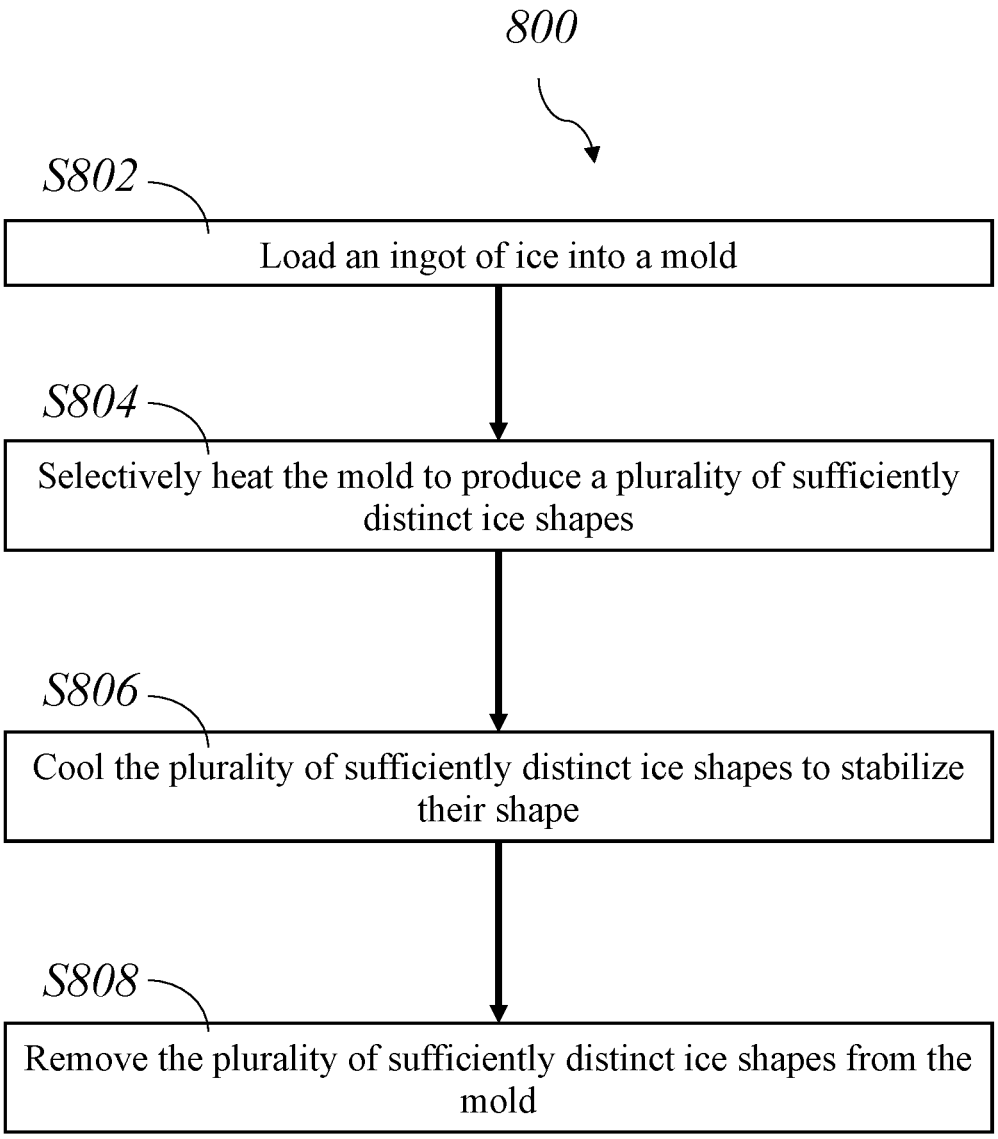
FIG. 8 is a flow diagram of another process for shaping ice.

FIG. 8 is a flow diagram of a process 800 for shaping ice. As shown in FIG. 8, a process 800 for shaping clear ice in one embodiment includes loading an ingot of ice into a heated mold in block S802, selectively heating the heated mold to produce (e.g., shape) a plurality of sufficiently distinct ice shapes in block S804, cooling the plurality of sufficiently distinct ice shapes to stabilize their shape in block S806, and removing the plurality of sufficiently distinct ice shapes from the heated mold.

In Step S802, the process 800 includes loading an ingot of ice into a heated mold. The heated mold can be the devices of any of FIGS. 1-5C in certain embodiments. The ingot of ice can be positioned according to an alignment of its dimensions with that of the device in some embodiments or with the use of a digital vision system as described herein. In some embodiments, the ingot of ice can be loaded manually by hand. In some embodiments, the ingot of ice can be loaded automatically by a conveyor system (not shown) or another mechanism.

In Step S804, the process 800 includes selectively heating the heated mold to produce a plurality of sufficiently distinct ice shapes. As described elsewhere herein, a heated mold can include an arrangement of heating elements such that during a heating operation of the heated mold, heat from the heating elements, as well as slight pressure from actuators of the heated mold in various embodiments, selectively melts and forces the ingot of ice to take the shape defined by the mold cavities of the heated mold to produce a plurality of sufficiently distinct ice shapes.

As described above in some embodiments, the plurality of sufficiently distinct ice shapes are indeed fully separate and independent shapes of ice. Any further processing or packaging of the ice shapes in these embodiments would generally account for the individual handling of each. However, in some embodiments, the heated mold can be adapted such that the plurality of sufficiently distinct ice shapes are tethered to each other by a small bridge of ice forming what can be considered a sprue of sufficiently distinct ice shapes. In these embodiments, having the plurality of sufficiently distinct ice shapes as a sprue can allow for the bulk handling of the plurality of sufficiently distinct ice shapes in subsequent processing or packing operations. In many of these embodiments, the small ice bridges of a sprue of sufficiently distinct ice shapes are adapted to be readily and cleanly severed when bulk handling is no longer desired.

Next, in Step S806, the process 800 includes cooling the plurality of sufficiently distinct ice shapes to stabilize their shape. In certain embodiments, this cooling can be important to prevent the deterioration of the plurality of sufficiently distinct ice shapes by further melting. In some of these embodiments, it can be necessary to cool to limit one of the cooling temperature and/or cooling duration of this step in order to prevent the plurality of sufficiently distinct ice shapes from adhering to the walls of the heated mold.

Finally, in Step S808, the process 800 includes removing the plurality of sufficiently distinct ice shapes from the heated mold. In some embodiments, the plurality of sufficiently distinct ice shapes can be removed manually by hand. In some embodiments, the plurality of sufficiently distinct ice shapes can be removed automatically such as by an opening and rotating motion of the heated mold. One of skill in the art will appreciate that in some embodiments, the order of Step S806 and Step S808 can be swapped with little to no effect on the efficacy of the process.

The methods of the preferred embodiment and variations thereof can be embodied and/or implemented at least in part as a machine configured to receive a computer-readable medium storing computer-readable instructions. The instructions are preferably executed by computer-executable components preferably integrated with the system and one or more portions of the processor on a computing device in communication with various components of the device for producing and/or shaping clear ice, such as but not limited to its various valves. The computer-readable medium can be stored on any suitable computer-readable media such as RAMs, ROMs, flash memory, EEPROMs, optical devices (e.g., CD or DVD), hard drives, floppy drives, or any suitable device. The computer-executable component is preferably a general or application-specific processor, but any suitable dedicated hardware or hardware/firmware combination can alternatively or additionally execute the instructions.

As used in the description and claims, the singular form "a", "an" and "the" include both singular and plural references unless the context clearly dictates otherwise. For example, the term "mold" may include, and is contemplated to include, a plurality of molds. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. An apparatus comprising:

a support structure;

a mold for shaping an ice ingot, the mold being mounted to the support structure and including:

a first mold housing having one or more surfaces and at least one first heat exchanger layer comprising a first plurality of fluid channels extending at least a portion of a length of the first mold housing, each of the first plurality of fluid channels including an inlet and an outlet; and a second mold housing having one or more surfaces and at least one second heat exchanger layer comprising a second plurality of fluid channels extending at least a portion of a length of the second mold housing, each of the second plurality of fluid channels including an inlet and an outlet; and a first upper platen assembly disposed above a first lower platen assembly, each of the first upper platen assembly and the first lower platen assembly including at least one channel for receiving liquid therethrough;

a first positioning means for disposing at least one of the one or more surfaces of the first mold housing adjacent to the first upper platen assembly and disposing at least one of the one or more surfaces of the second mold housing to the first lower platen assembly to cause the shaping of the ice ingot, the first positioning means including a linear actuator; and at least one liquid inlet valve for each of the first upper platen assembly and the first lower platen assembly, each liquid inlet valve configured to control a flow of liquid through the at least one channel of the first upper platen assembly and the at least one channel of the first lower platen assembly.

2. The apparatus of claim 1, wherein at least one of the one or more surfaces of the first mold housing and at least one of the one or more surfaces of the second mold housing define a plurality of mold cavities when placed in an adjacent position.

3. The apparatus of claim 1, wherein:

the first mold housing and the second mold housing are suspended between the first lower platen assembly and the first upper platen assembly; and the first positioning means is configured to enable a vertical upward movement of the first lower platen assembly until the first lower platen assembly contacts the at least one of the one or more surfaces of the second mold housing.

4. The apparatus of claim 1, wherein:

the first mold housing and the second mold housing are suspended between the first lower platen assembly and the first upper platen assembly by at least two vertical reciprocating shafts.

5. The apparatus of claim 1, wherein the first positioning means is configured to enable a vertical upward movement of the first mold housing until the at least one of the one or more surfaces of the first mold housing contacts the first upper platen assembly.

6. The apparatus of claim 1, wherein:

the first positioning means is configured to cause a vertical upward movement of the first lower platen assembly until the first lower platen assembly is in contact with the at least one of the one or more surfaces of the second mold housing;

the first positioning means is configured to cause a vertical upward movement of the first mold housing until the at least one of the one or more surfaces of the first mold housing contacts the first upper platen assembly;

the liquid comprises water heated to cause the first upper platen assembly and the first lower platen assembly to be heated to a surface temperature of at least a temperature of about 40 degrees Celsius; and the first mold housing and the second mold housing are thermally heated based on the contact with the at least one of the one or more surfaces of the first mold housing and the first upper platen assembly and the contact with the at least one of the one or more surfaces of the second mold housing and the first lower platen assembly.

7. The apparatus of claim 6, wherein thermally heating the first mold housing and the second mold housing comprises electronically heating the first lower platen assembly and the first upper platen assembly.

8. The apparatus of claim 1, further comprising:

a transfer table to receive the mold; and a second upper platen assembly disposed above a second lower platen assembly, wherein the second upper platen assembly comprises a housing mechanically connected to the support structure, the second upper platen assembly and the second lower platen assembly being adjacent to the first upper platen assembly and controlled by a second positioning means.

9. The apparatus of claim 8, wherein the second upper platen assembly and the second lower platen assembly are configured to cool the mold based on a trigger event received by the second positioning means, the trigger event causing a vertical upward movement of the first mold housing until at least one of the one or more surfaces of the first mold housing physically contacts the second upper platen assembly and at least one of the one or more surfaces of the second mold housing physically contacts the second lower platen assembly.

10. The apparatus of claim 1, wherein:

the first mold housing and the second mold housing are configured to maintain tension against the ice ingot when the ice ingot is placed between the first mold housing and the second mold housing, the tension being maintained during heating of the ice ingot and removed upon detecting that the first mold housing and the second mold housing are located a predefined distance apart; and removing the tension causes the first positioning means to trigger a downward movement of both the first lower platen assembly and the first mold housing to remove physical contact between the first mold housing and the first upper platen assembly and to remove the physical contact between the second mold housing and the first lower platen assembly.

11. The apparatus of claim 1, wherein:

the first upper platen assembly is fixed;

the first lower platen assembly is configured to move according to the first positioning means;

the first mold housing the second mold housing are configured to move according to the first positioning means; and in response to detecting that the first mold housing and the second mold housing are located a predefined distance apart, the first positioning means is configured to cause a downward movement of the first lower platen assembly, the first mold housing, and the second mold housing to remove physical contact between the first mold housing and the first upper platen assembly and to remove physical contact between the second mold housing and the first lower platen assembly.

12. The apparatus of claim 1, wherein the mold is semi-flexible and comprises a plurality of pockets, each pair of the plurality of pockets being disposed between an articulating joint to allow movement during heating or cooling of the ice ingot held by the mold.

13. The apparatus of claim 1, wherein:

the first mold housing further includes at least two side surfaces in contact with at least one top surface, the at least two side surfaces of the first mold housing including a plurality of structures that extend into a plurality of mold cavities formed when the first mold housing is placed adjacent to the second mold housing to hold the ice ingot; and the second mold housing further includes at least two side surfaces attached to at least one bottom surface, the at least two side surfaces of the second mold housing including a plurality of additional structures that extend into the plurality of mold cavities to hold the ingot.

14. The apparatus of claim 1, wherein the mold is interchangeable with molds of a plurality of shapes and sizes.

15. The apparatus of claim 1, wherein the mold further comprises a plurality of outlets configured to drain liquid water from a plurality of cavities associated with the mold.

16. The apparatus of claim 1, further comprising a computing device, wherein the computing device includes at least one processor and memory storing instructions that when executed cause the at least one processor device to generate and trigger display of at least one user interface configured to receive user input corresponding to a platen clamping metric, a recipe for shaping the ice ingot, a mold size, and a mold shape.

17. The apparatus of claim 16, wherein the computing device is further configured to provide instructions to:

cause the mold to at least partially encapsulate the ice ingot;

cause thermal heating of the first lower platen assembly and the first upper platen assembly to a predefined temperature;

cause the first upper platen assembly to physically contact at least a first mold surface of the mold while causing the first lower platen assembly to physically contact at least a second mold surface of the mold, each physical contact triggering selective heating of the ice ingot, for a predefined time period, such that the ice ingot selectively melts to form a plurality of sufficiently distinct ice shapes as defined by a plurality of mold cavities of the mold; and in response to detecting that the first mold housing and the second mold housing are located a predefined distance apart, cause a downward movement of both the first lower platen assembly and the mold to remove the physical contact between the first mold surface and the first upper platen assembly and to remove the physical contact between the second mold surface and the first lower platen assembly.

18. The apparatus of claim 1, wherein the ice ingot is a frozen elongate ice ingot with a length of about one meter to about four meters.

19. The apparatus of claim 1, wherein:

the first mold housing and the second mold housing are configured to at least partially encapsulate the ice ingot therebetween; and the first positioning means is configured to trigger movement of the first lower platen assembly toward the second platen assembly to cause the first mold housing and the second mold housing to apply pressure and heat on the ice ingot to selectively heat the ice ingot, for a predefined time period, such that the ice ingot selectively melts to form a plurality of sufficiently distinct ice shapes defined by a plurality of mold cavities of the mold.

20. An apparatus comprising:

a support structure;

a mold for shaping an elongate ice ingot into a plurality of sufficiently distinct ice shapes, the mold being mounted to the support structure and including:

a first mold housing having one or more surfaces and at least one first heat exchanger layer comprising a first plurality of fluid channels extending at least a portion of a length of the first mold housing, each of the first plurality of fluid channels including an inlet and an outlet; and a second mold housing having one or more surfaces and at least one second heat exchanger layer comprising a second plurality of fluid channels extending at least a portion of a length of the second mold housing, each of the second plurality of fluid channels including an inlet and an outlet, wherein the first mold housing and the second mold housing are configured to at least partially encapsulate the elongate ice ingot therebetween; and a first upper platen assembly disposed above a first lower platen assembly, each of the first upper platen assembly and the first lower platen assembly including at least one channel for receiving liquid therethrough;

a first positioning means for causing the first upper platen assembly to physically contact a first surface of the mold while causing the first lower platen assembly to physically contact a second surface of the mold; and at least one liquid inlet valve for each of the first upper platen assembly and the first lower platen assembly, each liquid inlet valve configured to control a flow of liquid through the at least one channel of the first upper platen assembly and through the at least one channel of the first lower platen assembly.

21. The apparatus of claim 20, wherein the first positioning means is configured to trigger movement of the first lower platen assembly toward the second platen assembly to cause the first mold housing and the second mold housing to apply pressure and heat on the elongate ice ingot to selectively heat the elongate ice ingot, for a predefined time period, such that the elongate ice ingot selectively melts to form the plurality of sufficiently distinct ice shapes defined by a plurality of mold cavities of the mold.

22. An apparatus comprising:

a support structure;

a mold for shaping ice ingots, the mold being mounted to the support structure and including:

a first mold housing having one or more surfaces and at least one first heat exchanger layer comprising a first plurality of fluid channels extending at least a portion of a length of the first mold housing, each of the first plurality of fluid channels including an inlet and an outlet; and a second mold housing having one or more surfaces and at least one second heat exchanger layer comprising a second plurality of fluid channels extending at least a portion of a length of the second mold housing, each of the second plurality of fluid channels including an inlet and an outlet; and a first upper platen assembly disposed above a first lower platen assembly, each of the first upper platen assembly and the first lower platen assembly including at least one channel for receiving liquid therethrough;

a first positioning means for disposing at least one of the one or more surfaces of the first mold housing adjacent to the first upper platen assembly and disposing at least one of the one or more surfaces of the second mold housing to the first lower platen assembly; and at least one liquid inlet valve for each of the first upper platen assembly and the first lower platen assembly, each liquid inlet valve configured to control a flow of liquid:

through the at least one channel of the first upper platen assembly and to the first plurality of fluid channels through each inlet in the first plurality of fluid channels and out through each outlet in the first plurality of fluid channels, or through the at least one channel of the first lower platen assembly and to the second plurality of fluid channels through each inlet in the second plurality of fluid channels and out through each outlet in the second plurality of fluid channels.

* * * * *